US012496484B2

(12) United States Patent
Bauerle et al.

(10) Patent No.: US 12,496,484 B2
(45) Date of Patent: Dec. 16, 2025

(54) EXERCISE APPARATUSES

(71) Applicant: Fusion Consults, LLC, Myrtle Beach, SC (US)

(72) Inventors: Wayne Bryan Bauerle, Myrtle Beach, SC (US); Anthony Devito, Myrtle Beach, SC (US)

(73) Assignee: Fusion Consults, LLC, Myrtle Beach, SC (US)

( * ) Notice: Subject to any disclaimer, the term of this patent is extended or adjusted under 35 U.S.C. 154(b) by 346 days.

(21) Appl. No.: 17/969,276

(22) Filed: Oct. 19, 2022

(65) Prior Publication Data

US 2023/0173332 A1 Jun. 8, 2023

Related U.S. Application Data

(60) Provisional application No. 63/392,649, filed on Jul. 27, 2022, provisional application No. 63/286,320, filed on Dec. 6, 2021.

(51) Int. Cl.

| | |
|---|---|
| ***A63B 21/00*** | (2006.01) |
| ***A63B 21/012*** | (2006.01) |
| ***A63B 21/072*** | (2006.01) |

(52) U.S. Cl.

CPC ..... *A63B 21/0724* (2013.01); *A63B 21/0125* (2013.01); *A63B 21/4035* (2015.10); *A63B 21/4049* (2015.10)

(58) Field of Classification Search

None

See application file for complete search history.

(56) References Cited

U.S. PATENT DOCUMENTS

| | | | | | |
|---|---|---|---|---|---|
| 3,384,370 | A * | 5/1968 | Bailey | A63B 21/0724 | 482/106 |
| 4,461,473 | A * | 7/1984 | Cole | A63B 21/0724 | 482/106 |
| 4,585,229 | A * | 4/1986 | Brasher | A63B 21/0724 | 482/106 |
| 4,629,184 | A * | 12/1986 | Selkee | A63B 21/0724 | 482/106 |
| 4,690,400 | A * | 9/1987 | Metz | A63B 21/0724 | 482/106 |

(Continued)

FOREIGN PATENT DOCUMENTS

| | | | | |
|---|---|---|---|---|
| DE | 223926 A1 * | 6/1985 | ..... | A63B 21/0724 |
| EP | 3583984 A1 * | 12/2019 | ..... | A63B 21/4035 |

*Primary Examiner* — Shila Jalalzadeh Abyaneh

(74) *Attorney, Agent, or Firm* — MacMillan, Sobanski & Todd, LLC

(57) ABSTRACT

Exercise apparatuses are described. An example exercise apparatus has a lengthwise axis and includes a first shaft, a first frame, a first handle, a second frame, and a second handle. The first shaft has a first shaft first end and a first shaft second end. The first frame is attached to the first shaft first end and defines a first frame passageway. The first handle is disposed within the first frame passageway such that the first handle can translate along the lengthwise axis and rotate within the first frame passageway. The second frame is attached to the first shaft second end and defines a second frame passageway. The second handle is disposed within the second frame passageway such that the second handle can translate along the lengthwise axis and rotate within the second frame passageway.

17 Claims, 15 Drawing Sheets

(56) References Cited

U.S. PATENT DOCUMENTS 4,743,018 A * 5/1988 Eckler ..... A63B 21/075 482/106
4,822,035 A * 4/1989 Jennings ..... A63B 21/0724 482/106
RE33,218 E * 5/1990 Twardosz ..... A63B 21/0724 482/106
5,024,434 A * 6/1991 Smith ..... A63B 21/0728 482/106
5,080,349 A * 1/1992 Vittone ..... A63B 23/14 482/106
5,211,616 A * 5/1993 Riley, Jr. ..... A63B 21/072 482/106
5,334,113 A * 8/1994 Roepke ..... A63B 21/4001 482/106
5,407,405 A * 4/1995 Oren ..... A63B 21/4035 482/106
5,718,654 A * 2/1998 Kennedy ..... A63B 21/4035 482/102
5,725,461 A * 3/1998 Bogard, II ..... A63B 21/072 482/106
6,022,300 A * 2/2000 Hightower ..... A63B 21/0728 482/106
7,094,186 B2 * 8/2006 Diakonov ..... A63B 21/0728 482/106
7,862,486 B1 * 1/2011 Watson ..... A63B 21/4017 482/106
8,672,815 B1 * 3/2014 Springer ..... A63B 21/0724 482/106
8,951,170 B1 * 2/2015 Tayo ..... A63B 21/0728 482/139
9,254,408 B1 * 2/2016 Otto ..... A63B 21/0724
9,855,459 B1 * 1/2018 Condara ..... A63B 21/0724
10,124,207 B2 * 11/2018 Artioli ..... A63B 21/0722
11,426,621 B2 8/2022 Bauerle
12,036,439 B2 * 7/2024 Gomes ..... A63B 21/4049
2003/0130096 A1 * 7/2003 LaCroce ..... A63B 21/0724 482/106
2004/0082448 A1 * 4/2004 Martin ..... A63B 21/4017 482/139
2005/0202942 A1 * 9/2005 De Lano ..... A63B 21/0724 482/106
2008/0176723 A1 * 7/2008 Johnson ..... A63B 21/0724 482/106
2011/0287909 A1 * 11/2011 Morris ..... A63B 23/12 482/122
2012/0115683 A1 * 5/2012 Ross ..... A63B 69/0057 482/38
2012/0152055 A1 * 6/2012 Lechuga Priego .... B62D 1/043 74/557
2013/0035218 A1 * 2/2013 Wierszewski ..... A63B 21/072 482/106
2013/0260969 A1 * 10/2013 Huang ..... A63B 21/00069 482/122
2018/0243605 A1 * 8/2018 Light ..... A63B 21/072
2019/0184225 A1 * 6/2019 Leoniak ..... A63B 21/154
2020/0188724 A1 * 6/2020 Bauerle ..... A63B 21/4049
2020/0289870 A1 * 9/2020 Olmstead ..... A63B 23/03525
2021/0154523 A1 * 5/2021 Hitman ..... A63B 23/1236
2022/0273979 A1 * 9/2022 Kinney ..... A63B 21/4035

* cited by examiner

EXERCISE APPARATUSES

RELATED APPLICATIONS

This application claims the benefit of U.S. Provisional Application No. 63/286,320, which was filed on Dec. 6, 2021, and claims the benefit of U.S. Provisional Application No. 63/392,649, which was filed on Jul. 27, 2022. The entire disclosure of each of these related applications is hereby incorporated by reference into this disclosure.

FIELD

The disclosure relates generally to the field of exercise apparatuses. More particularly, the disclosure relates to exercise apparatuses that include a translatable and rotatable handle.

BACKGROUND

A common exercise performed by weightlifters is the bench press, which exercises the chest, triceps, and shoulders. To perform a bench press, the back is positioned flat on a bench at an angle relative to the floor on which the feet are positioned. Subsequently, the hands are positioned on a bar and a lift is performed. The placement of the hands on the bar is generally based on a specific distance from the center of the bar or markings incorporated into the bar, which are not customized to a specific weightlifter and can result in a less efficient lift. In addition, during a lift, the position of the hands is prevented from being altered since they are axially and rotationally fixed relative to the bar throughout the lift, which can increase stress on the shoulders and the surrounding tissues. Other exercises have similar drawbacks due to the fixed position of the hands relative to the lifting device during use.

A need exists, therefore, for new and useful exercise apparatuses.

SUMMARY OF SELECTED EXAMPLE EMBODIMENTS

Various exercise apparatuses are described herein.

An example exercise apparatus has a lengthwise axis and includes a first shaft, a first frame, a first handle, a second frame, and a second handle. The first shaft has a first shaft first end and a first shaft second end. The first frame is attached to the first shaft first end. The first frame defines a first frame passageway. The first handle is rotatably attached to the first frame and is disposed within the first frame passageway. The first handle is rotatable within the first frame passageway and is moveable along the lengthwise axis between a first position in which the first handle is disposed a first distance from the first shaft and a second position in which the first handle is disposed a second distance from the first shaft. The second distance is greater than the first distance. The second frame is attached to the first shaft second end. The second frame defines a second frame passageway. The second handle is rotatably attached to the second frame and is disposed within the second frame passageway. The second handle is rotatable within the second frame passageway and is moveable along the lengthwise axis between a third position in which the second handle is disposed a third distance from the first shaft and a fourth position in which the second handle is disposed a fourth distance from the first shaft. The fourth distance is greater than the third distance.

Another example exercise apparatus has a lengthwise axis and includes a first frame and a first handle. The first frame has a housing and defines a first frame passageway. The housing has a first end and a second end. The first handle is rotatably attached to the first frame and is disposed within the first frame passageway. The first handle is rotatable within the first frame passageway and is moveable along the lengthwise axis between a first position in which the first handle is disposed a first distance from the first end of the housing and a second position in which the first handle is disposed a second distance from the first end of the housing. The second distance is greater than the first distance.

Another example exercise apparatus has a lengthwise axis and includes a first frame and a first handle. The first frame defines a first frame passageway and has a housing, a first track member, a second track member, a plurality of ball bearings, a first cover, and a second cover. The housing has a first end, a second end, and defines a housing passageway. Each of the first and second track members is attached to the housing. A first set of ball bearings of the plurality of ball bearings is disposed between the first track member and the first cover. A second set of ball bearings of the plurality of ball bearings is disposed between the second track member and the second cover. A portion of each ball bearing of the plurality of ball bearings disposed within the handle passageway. Each of the first and second covers attached to the housing. The first handle is rotatably attached to the first frame and is disposed within the first frame passageway. The first handle is rotatable within the first frame passageway and has 360 degrees of rotation within the first frame passageway. The first handle is moveable along the lengthwise axis between a first position in which the first handle is disposed a first distance from the first end of the housing and a second position in which the first handle is disposed a second distance from the first end of the housing. The second distance is greater than the first distance.

Additional understanding of the example exercise apparatuses can be obtained by review of the detailed description, below, and the appended drawings.

DETAILED DESCRIPTION

Figure 1:
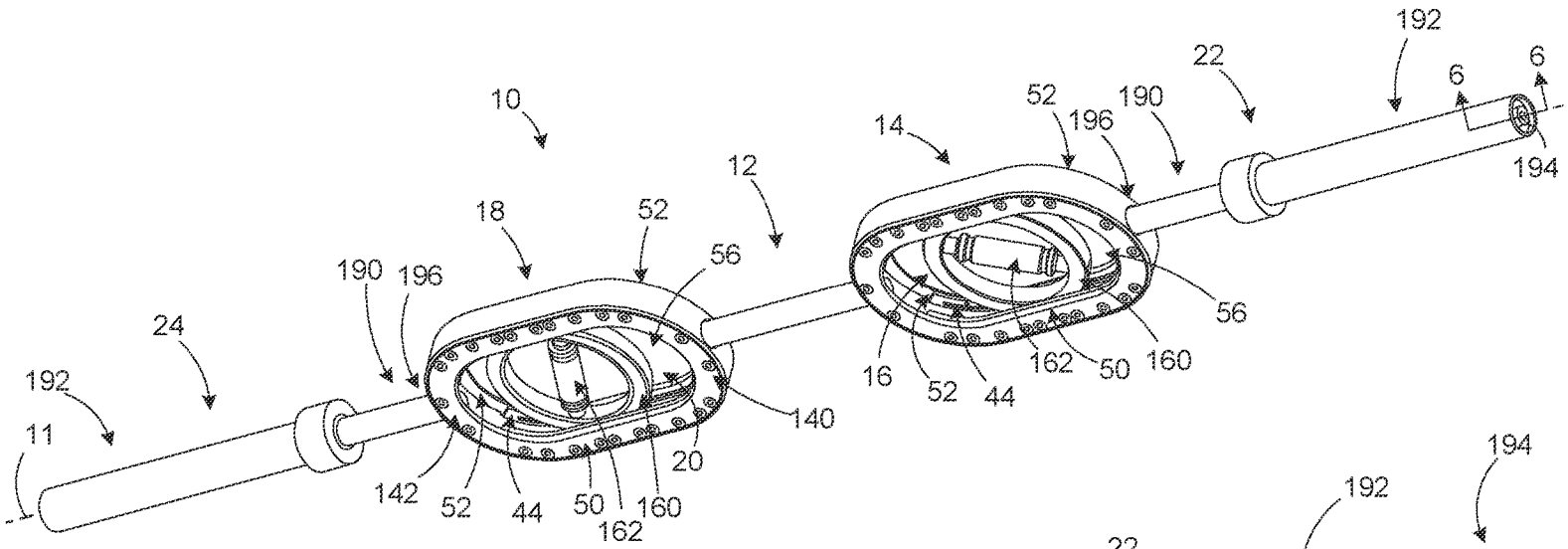
FIG. 1 is a perspective view of an example exercise apparatus.
Figure 2:
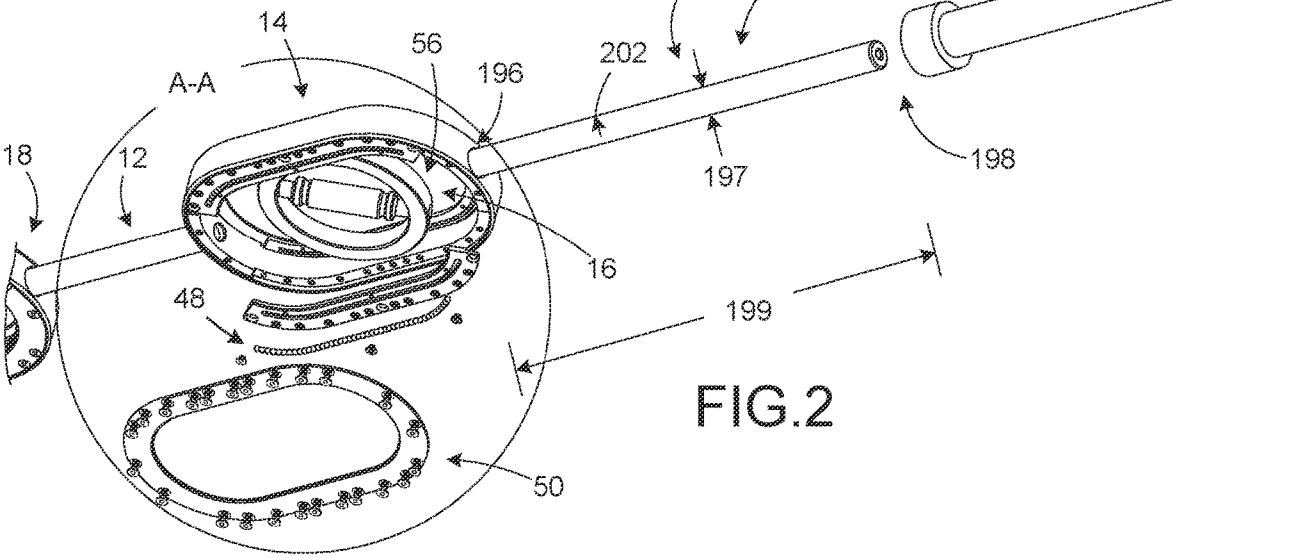
FIG. 2 is a partially exploded partial perspective view of the exercise apparatus illustrated in FIG. 1.
Figure 3:
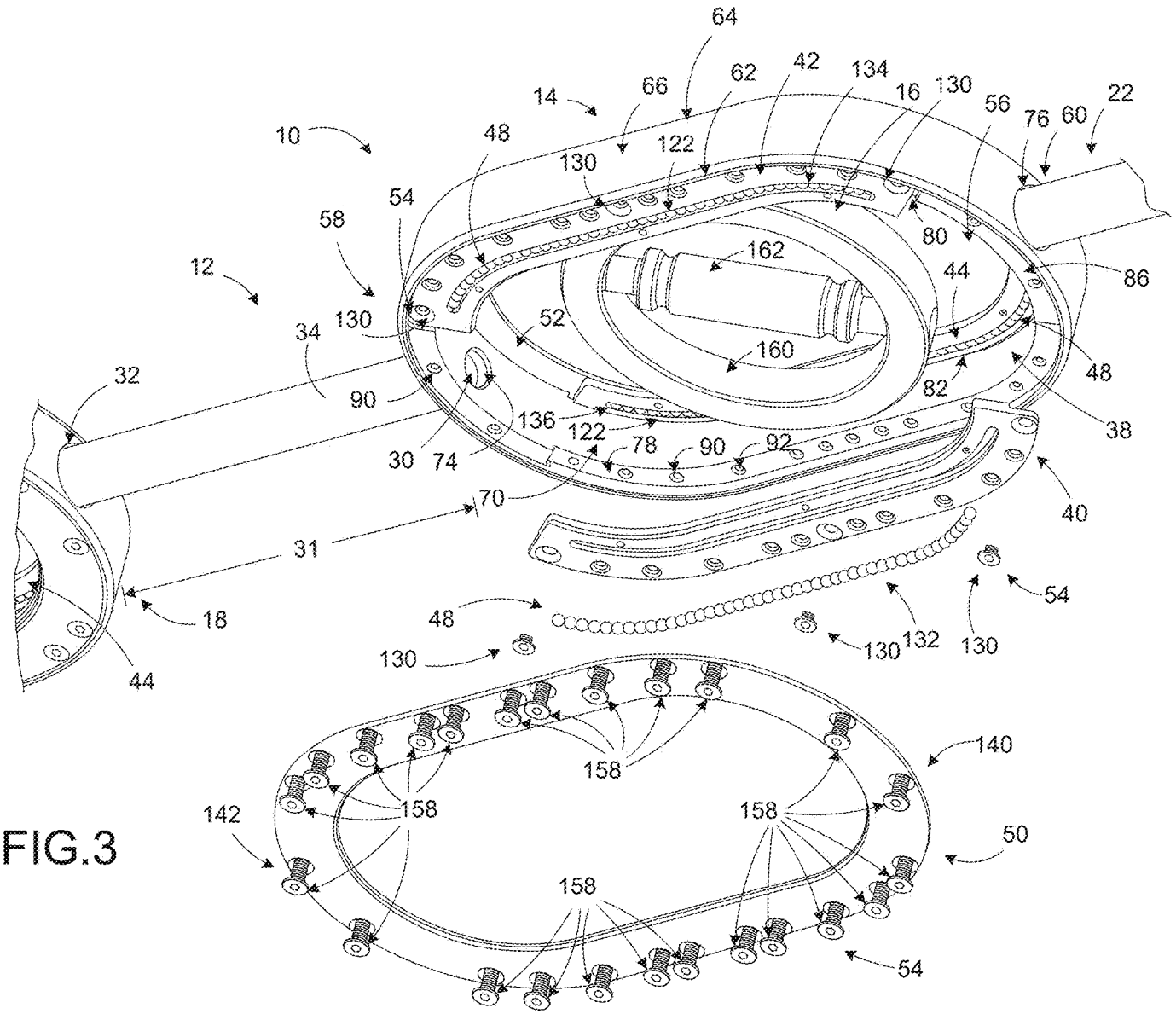
FIG. 3 is a magnified view of area A-A in FIG. 2.
Figure 4:
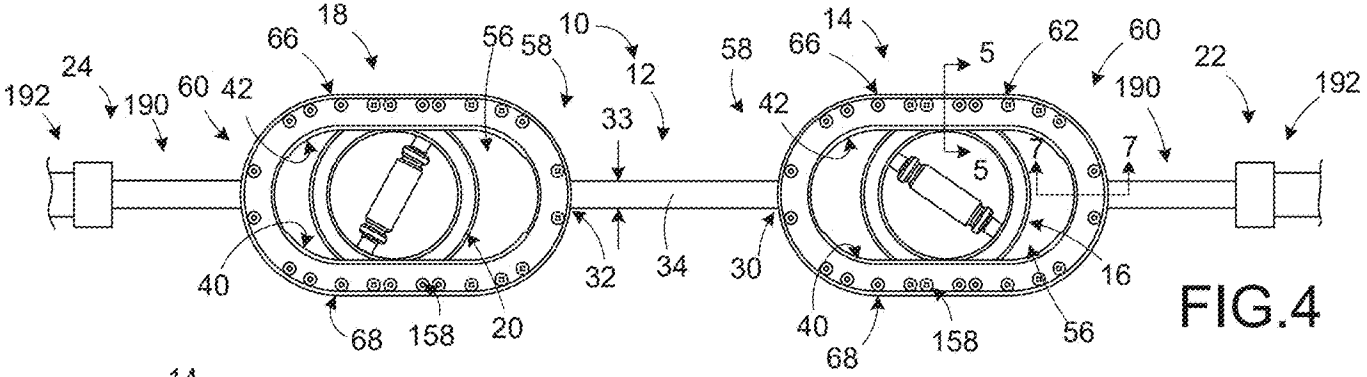
FIG. 4 is a partial front view of the exercise apparatus illustrated in FIG. 1.
Figure 6:
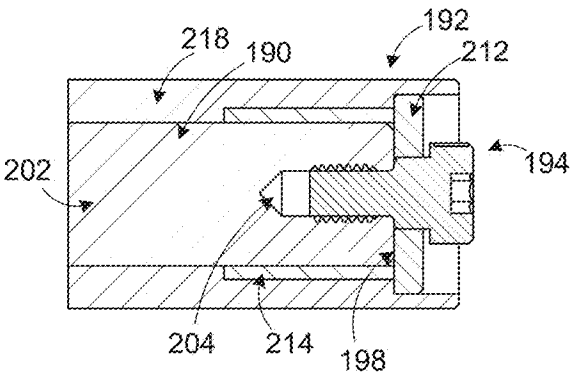
FIG. 6 is a cross-sectional view of the exercise apparatus illustrated in FIG. 1 taken along line 6-6.
Figure 7:
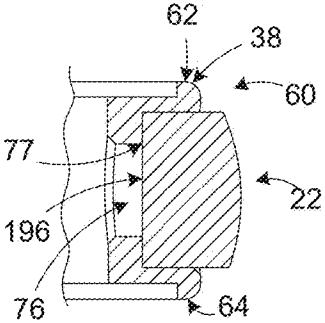
FIG. 7 is a partial cross-sectional view of the exercise apparatus illustrated in FIG. 4 taken along line 7-7.
Figure 5:
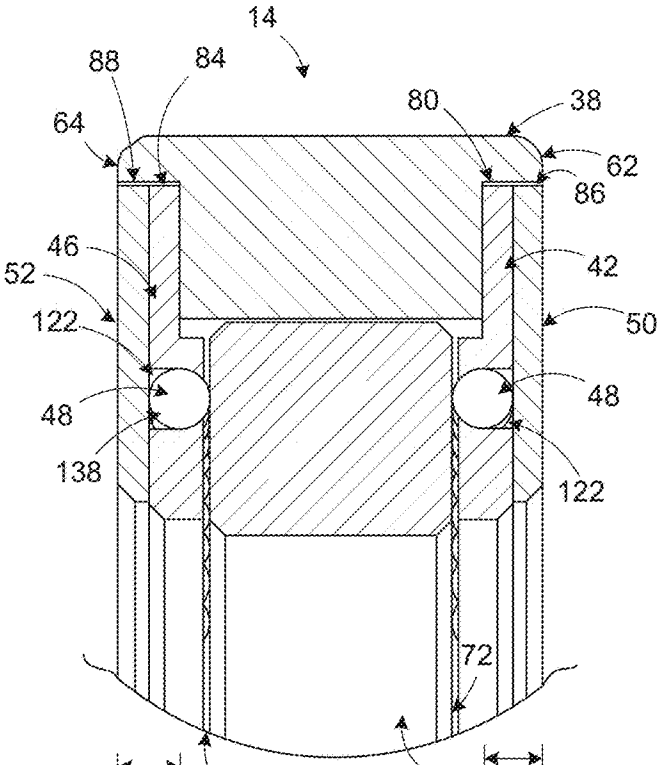
FIG. 5 is a partial cross-sectional view of the exercise apparatus illustrated in FIG. 4 taken along line 5-5.
Figure 10:
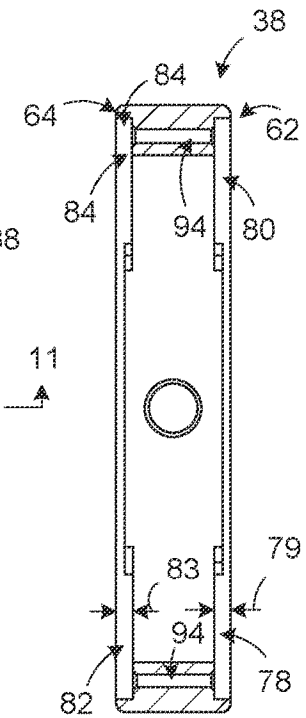
FIG. 10 is a cross-sectional view of the housing illustrated in FIG. 8 taken along line 10-10.
Figure 8:
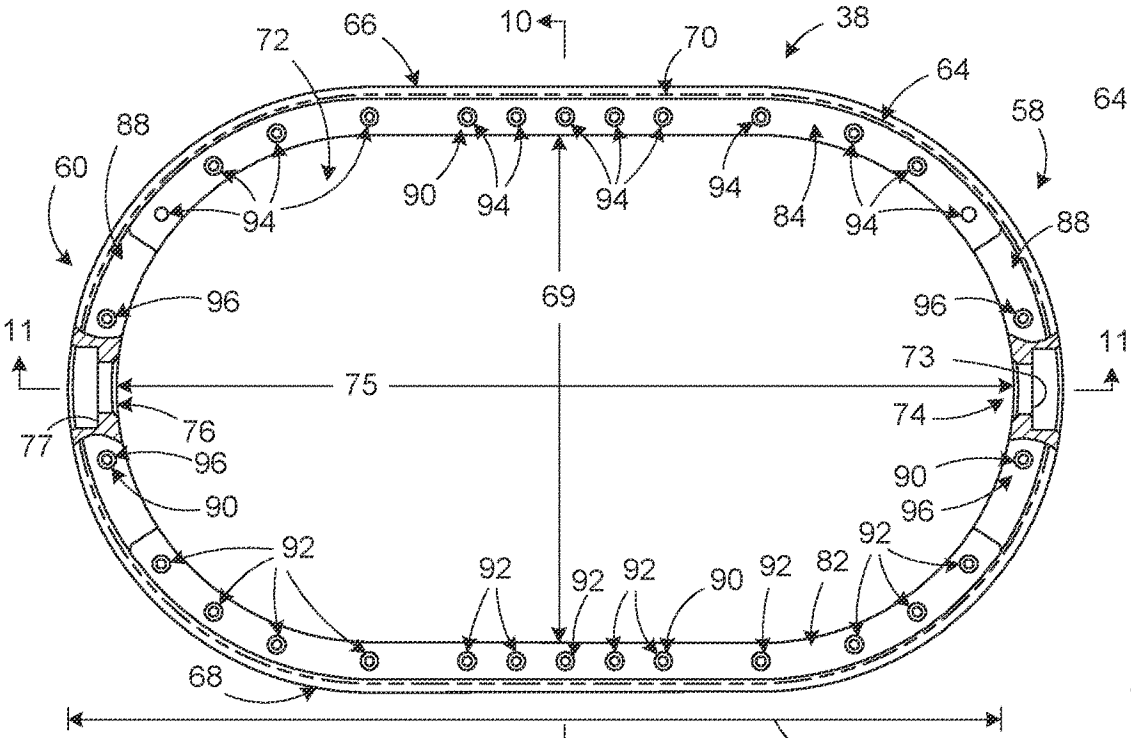
FIG. 8 is a partially broken away rear view of a housing of the frame of the exercise apparatus illustrated in FIG. 1.
Figure 11:
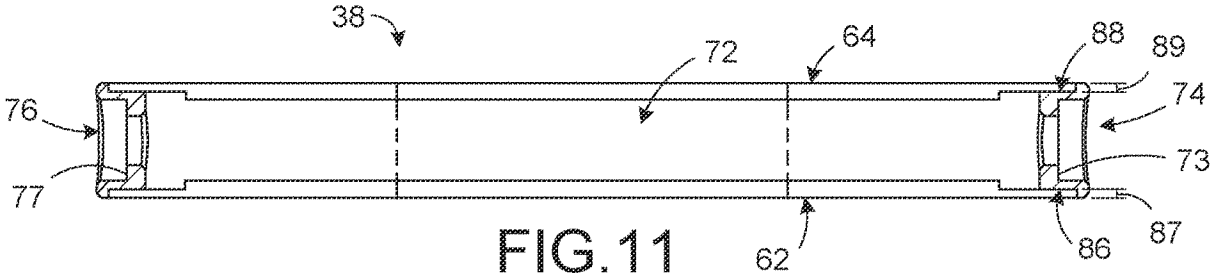
FIG. 11 is a cross-sectional view of the housing illustrated in FIG. 8 taken along line 11-11.
Figure 9:
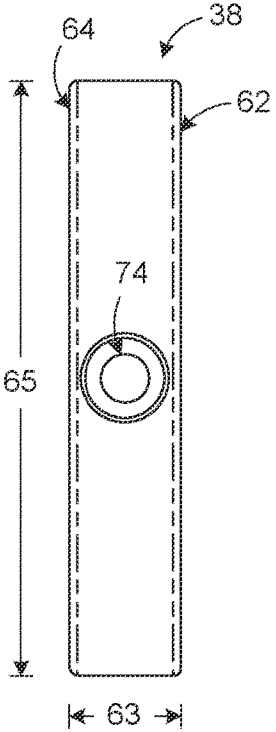
FIG. 9 is a side view of the housing illustrated in FIG. 8.

The following detailed description and the appended drawings describe and illustrate various example embodiments of exercise apparatuses. The description and illustration of these examples are provided to enable one skilled in the art to make and use an exercise apparatus. They are not intended to limit the scope of the claims in any manner. The invention is capable of being practiced or carried out in various ways and the examples described and illustrated herein are merely selected examples of the various ways of practicing or carrying out the invention and are not considered exhaustive.

FIGS. 1 through 21 illustrate an example exercise apparatus 10. The exercise apparatus 10 has a lengthwise axis 11 and includes a first shaft 12, a first frame 14 attached to the first shaft 12, a first handle 16 attached, and moveable relative, to the first frame 14, a second frame 18 attached to the first shaft 12, a second handle 20 attached, and moveable relative, to the second frame 18, a second shaft 22 attached to the first frame 14, and a third shaft 24 attached to the second frame 18.

The first shaft 12 is disposed between and attached to the first frame 14 and the second frame 18. In the illustrated embodiment, and as best shown in FIGS. 1 through 4, the first shaft 12 has a first shaft first end 30, a first shaft second end 32, a first shaft length 31 that extends from the first shaft first end 30 to the first shaft second end 32, a first shaft outside diameter 33, and a first shaft main body 34. In the embodiment illustrated, the first shaft 12 is an elongate rod that provides structural support between the first and second frames 14, 18.

The first frame 14 is attached to the first shaft first end 30 and the second shaft 22 and is disposed between the first shaft 12 and the second shaft 22. The second frame 18 is attached to the first shaft second end 32 and the third shaft 24 and is disposed between the first shaft 12 and the third shaft 24. As best shown in FIGS. 1 through 5 and 7 through 15, each of the first frame 14 and the second frame 18 includes a housing 38, a first track member 40, a second track member 42, a third track member 44, a fourth track member 46, a plurality of ball bearings 48, a first cover 50, a second cover 52, a plurality of attachment members 54, and defines a frame passageway 56. The first and second track members 40, 42 are disposed between the first cover 50 and the housing 38 and the third and fourth track members 44, 46 are disposed between the second cover 52 and the housing 38.

The housing 38 of the first frame 14 is attached to the first shaft 12 and the second shaft 22. The housing 38 of the second frame 18 is attached to the first shaft 12 and the third shaft 24. As shown in FIGS. 3 through 5, 7, and 8 through 11, the housing 38 has a first end 58, a second end 60, a front side 62, a rear side 64, a top 66, a bottom 68, a length 61, a width 63, and a height 65, and a main body 70 that defines a handle passageway 72, a first passageway 74, a second passageway 76, a first track member recess 78, a second track member recess 80, a third track member recess 82, a fourth track member recess 84, a first cover recess 86, a second cover recess 88, and a plurality of attachment member passageways 90.

The length 61 extends from the first end 58 to the second end 60. The width 63 extends from the front side 62 to the rear side 64. The height 65 extends from the top 66 to the bottom 68. In the embodiment illustrated, the length 61 is greater than the height 65 such that the housing 38 is elongated and can provide translation and rotation of a handle along the lengthwise axis of the exercise apparatus 10, as described herein. The handle passageway 72 extends from the front side 62 to the rear side 64, has a height 69 and a length 75, and is sized to receive a handle. The first passageway 74 extends from the first end 58 to the handle passageway 72. A shoulder 73 is defined within the first passageway 74 and provides a mechanical stop to advancement of the first shaft 12 into the first passageway 74. The first passageway 74 is sized to receive a portion of the first shaft 12 such that the first shaft 12 contacts the shoulder 73 and attachment between the first shaft 12 and the housing 38 can be accomplished (e.g., by welding the two components to one another). The second passageway 76 extends from the second end 60 to the handle passageway 72. A shoulder 77 is defined within the second passageway 76 and provides a mechanical stop to advancement of a second shaft 22 into the second passageway 76 of the housing 38 of the first frame 14 and advancement of a third shaft 24 into the second passageway 76 of the housing 38 of the second frame 18. The second passageway 76 of the housing 38 of the first frame 14 is sized to receive a portion of the second shaft 22 such that the second shaft 22 contacts the shoulder 77 and attachment between the second shaft 22 and the housing 38 can be accomplished (e.g., by welding the two components to one another). The second passageway 76 of the housing 38 of the second frame 18 is sized to receive a portion of the third shaft 24 such that the third shaft 24 contacts the shoulder 77 and attachment between the third shaft 24 and the housing 38 can be accomplished (e.g., by welding the two components to one another).

Each of the first track member recess 78 and the second track member recess 80 extends from the front side 62 toward the rear side 64 a depth 79 and along a portion of the enclosed boundary of the handle passageway 72. Each of the third track member recess 82 and the fourth track member recess 84 extends from the rear side 64 toward the front side 62 a depth 83 and along a portion of the enclosed boundary of the handle passageway 72. The depth 79 of each of the first and second track member recesses 78, 80 and the depth 83 of the third and fourth track member recesses 82, 84 is greater than the second width 115 of a track member and sized to receive a track member, as described in more detail herein. In the illustrated embodiment, the depth 79 of each of the first and second track member recesses 78, 80 and the depth 83 of each of the third and fourth track member recesses 82, 84 is substantially equal to the sum of the second width 115 of a track member and the width 143 of a cover. Alternative embodiments can define a track member recess that extends along the entire enclosed boundary of a handle passageway.

The first cover recess 86 extends from the front side 62 toward the rear side 64 a depth 87 and along the entire enclosed boundary of the handle passageway 72. The second cover recess 88 extends from the rear side 64 toward the front side 62 a depth 89 and along the entire enclosed boundary of the handle passageway 72. The depth 87 of each of the first cover recess 86 and the depth 89 of the second cover recess 88 is substantially equal to the width 143 of a cover and sized to receive a cover, as described in more detail herein.

In the illustrated embodiment, the main body 70 defines threads within each passageway of the plurality of attachment member passageways 90 that mate with an attachment member of the plurality of attachment members 54. However, in alternative embodiments, and depending on the type of attachment member being used, a main body can define any suitable structure within a passageway, or recess, defined by the main body that is sized to receive an attachment member. Each passageway of the plurality of attachment member passageways 90 is sized to receive an attachment member of the plurality of attachment members 54. A first set of passageways 92 of the plurality of attachment member passageways 90 extend from the first track member recess 78 to the third track member recess 82. A second set of passageways 94 of the plurality of attachment member passageways 90 extend from the second track member recess 80 to the fourth track member recess 84. A third set of passageways 96 of the plurality of attachment member passageways 90 extend from the first cover recess 86 to the second cover recess 88. While a plurality of attachment member passageways have been described, alternative embodiments can include recesses that extend through a portion of the width of a housing to achieve attachment of the various components, as described herein.

Figure 15:
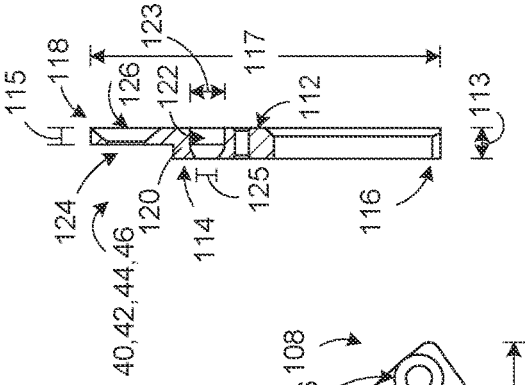
FIG. 15 is a cross-sectional view of the track member illustrated in FIG. 14 taken along line 15-15.
Figure 14:
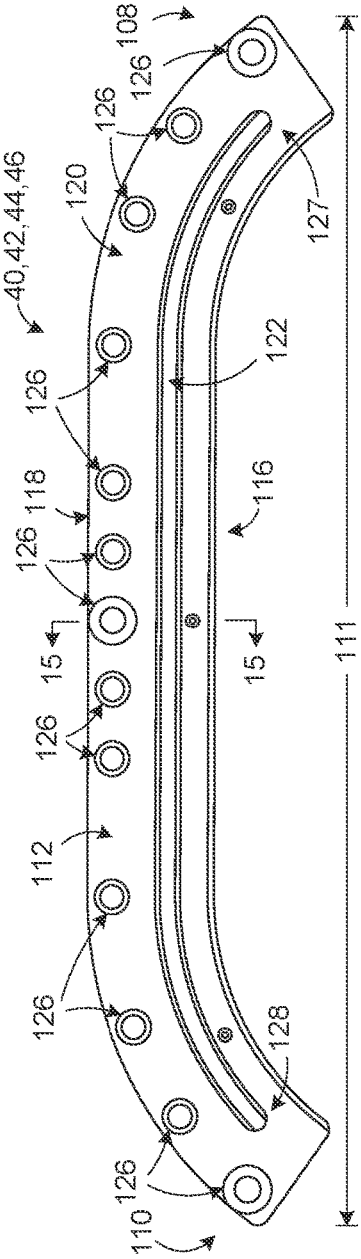
FIG. 14 is a front view of a track member of the frame of the exercise apparatus illustrated in FIG. 1.
Figure 18:
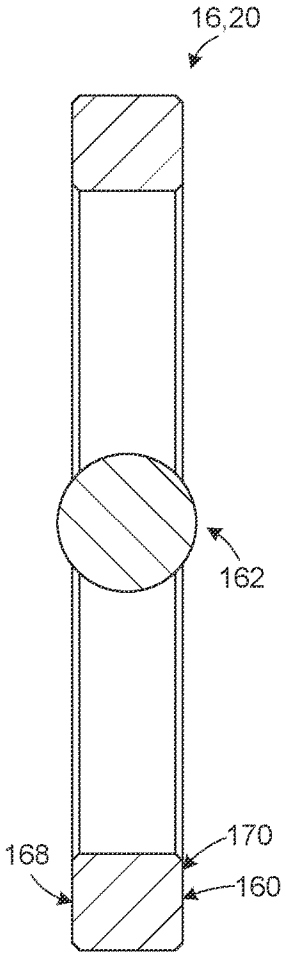
FIG. 18 is a cross-sectional view of the handle illustrated in FIG. 16 taken along line 18-18.
Figure 19:
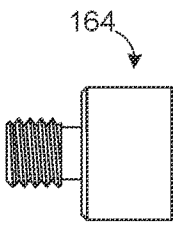
FIG. 19 is a side view of an anchor member of the handle illustrated in FIG. 16.
Figure 16:
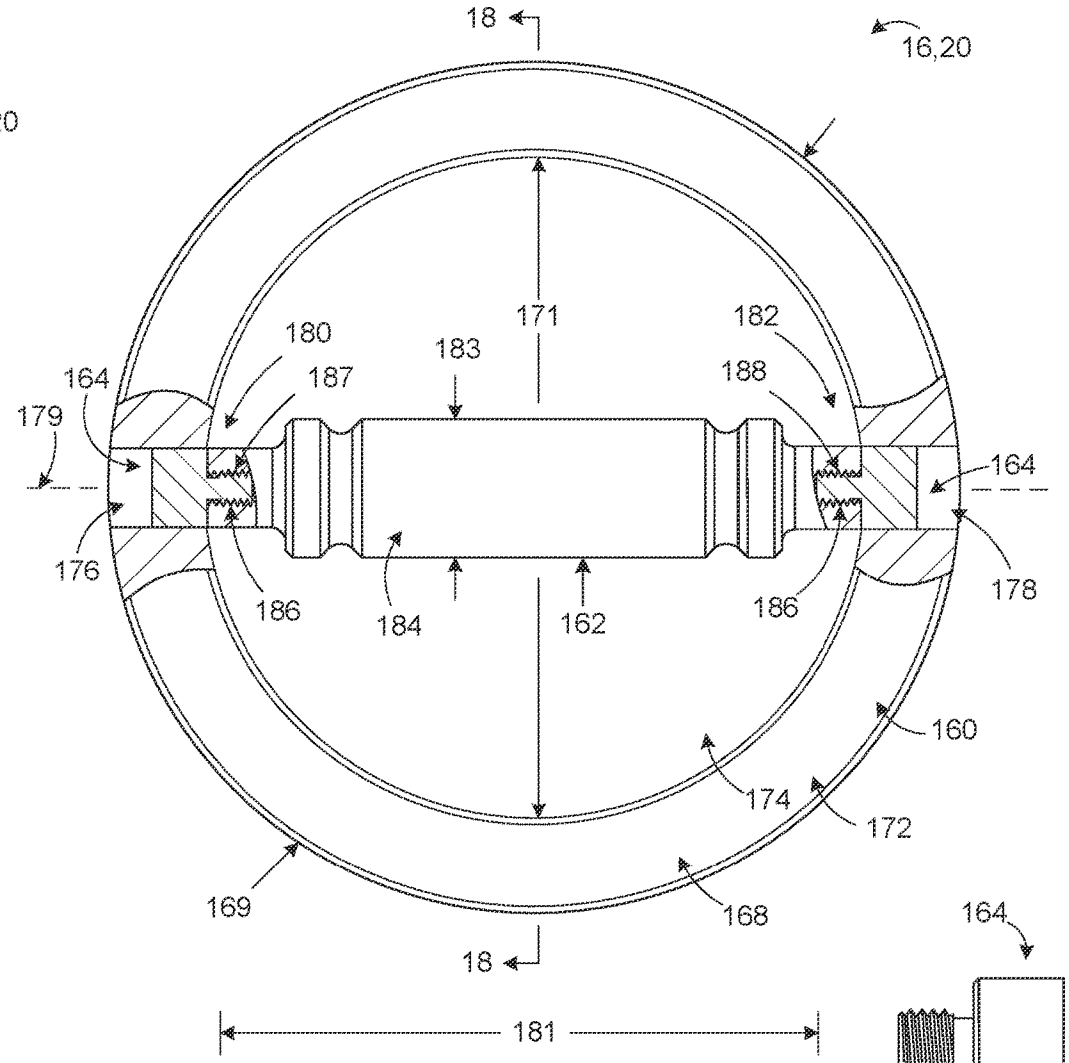
FIG. 16 is a partially broken away front view of a handle of the exercise apparatus illustrated in FIG. 1.
Figure 17:
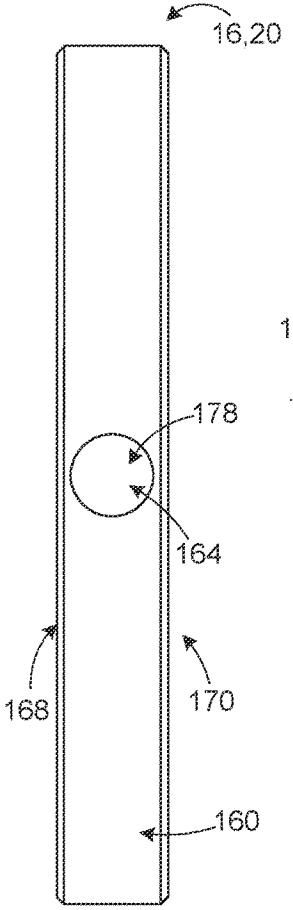
FIG. 17 is a side view of the handle illustrated in FIG. 16.

In the illustrated embodiment, and as shown in FIGS. 14 and 15, each of the first track member 40, the second track member 42, the third track member 44, and the fourth track member 46 has a first end 108, a second end 110, a front side 112, a rear side 114, a top 116, a bottom 118, a length 111, a first width 113, a second width 115, a height 117, and a main body 120 that defines a ball bearing passageway 122, a housing recess 124, a plurality of attachment member passageways 126. As shown in FIG. 14, each of the first track member 40, the second track member 42, the third track member 44, and the fourth track member 46 is a u-shaped member that partially surrounds the frame passageway 56. However, alternative embodiments can include one or more track members that define any suitable shape (e.g., completely surrounds a frame passageway) that mates with a recess defined by a housing.

The length 111 extends from the first end 108 to the second end 110. The first width 113 extends from the front side 112 to the rear side 114 between the top 116 and the housing recess 124. The second width 115 extends from the front side 112 to the rear side 114 along the housing recess 124. The height 117 extends from the top 116 to the bottom 118. In the embodiment illustrated, the length 111 is greater than the height 117 such that each of the track members 40, 42, 44, 46 is elongated and can provide translation and rotation of a handle along the lengthwise axis of the exercise apparatus 10, as described herein.

The ball bearing passageway 122 extends from the front side 112 to the rear side 114, has a first end 127, a second end 128, and is disposed between the top 116 and the housing recess 124 such that it has direct access to the handle passageway 72 defined by the housing 38 when the exercise apparatus 10 is assembled. The ball bearing passageway 122 is sized to receive a set of ball bearings of the plurality of ball bearings 48, as described herein. The ball bearing passageway 122 has a first width 123 at the front side 112 and a second width 125 at the rear side 114 that is less than the first width 123. This structural configuration provides a mechanism for maintaining a set of ball bearings of the plurality of ball bearings 48 between a track member and a cover such that a portion of each ball bearing of the set of ball bearings is partially disposed outside of the ball bearing passageway 122, within the handle passageway 72, and can contact a handle.

The housing recess 124 extends from the rear side 114 toward the front side 112 and extends from the bottom 118 toward the top 116 such that it terminates between the ball bearing passageway 122 and the bottom 118. The housing recess 124 is sized to receive a portion of the housing 38 such that the ball bearing passageway 122 has direct access to the handle passageway 72 when the exercise apparatus 10 is assembled (e.g., an axis extending through the center of the ball bearing passageway 122 extends into the handle passageway 72).

Each passageway of the plurality of attachment member passageways 126 is sized to receive a portion of an attachment member of the plurality of attachment members 54. Each passageway of the plurality of attachment member passageways 126 extends from the front side 112 to the housing recess 124. When assembled, the plurality of attachment member passageways 126 of the first track member 40 are coaxial with the first set of passageways 92 of the plurality of attachment member passageways 90 defined by the housing 38. When assembled, the plurality of attachment member passageways 126 of the second track member 42 are coaxial with the second set of passageways 94 of the plurality of attachment member passageways 90 defined by the housing 38. When assembled, the plurality of attachment member passageways 126 of the third track member 44 are coaxial with the first set of passageways 92 of the plurality of attachment member passageways 90 defined by the housing 38. When assembled, the plurality of attachment member passageways 126 of the fourth track member 46 are coaxial with the second set of passageways 94 of the plurality of attachment member passageways 90 defined by the housing 38.

A set of attachment members 130 of the plurality of attachment members 54 is used to attach each of the track members 40, 42, 44, 46 to the housing 38. Each attachment member of the set of attachment members 130 extends through a passageway of the plurality of attachment member passageways 126 and is disposed within a passageway of the plurality of attachment member passageways 90 to accomplish attachment of a track to the housing 38.

A first set of ball bearings 132 of the plurality of ball bearings 48 is moveably disposed within the ball bearing passageway 122 of the first track member 40 and between the first track member 40 and the first cover 50. A second set of ball bearings 134 of the plurality of ball bearings 48 is moveably disposed within the ball bearing passageway 122 of the second track member 42 and between the second track member 42 and the first cover 50. A third set of ball bearings 136 of the plurality of ball bearings 48 is moveably disposed within the ball bearing passageway 122 of the third track member 44 and between the third track member 44 and the second cover 52. A fourth set of ball bearings 138 of the plurality of ball bearings 48 is moveably disposed within the ball bearing passageway 122 of the fourth track member 46 and between the fourth track member 46 and the second cover 52. Each ball bearing of the plurality of ball bearings 48 is sized such that a portion of each ball bearing of the set of ball bearings is partially disposed outside of the ball bearing passageway 122, within the handle passageway 72, and can contact a handle during use.

Figure 13:
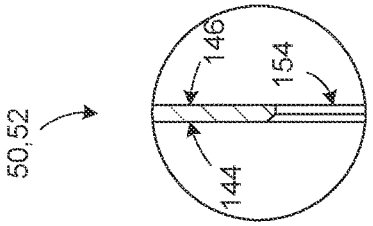
FIG. 13 is a cross-sectional view of the cover illustrated in FIG. 12 taken along line 13-13.
Figure 12:
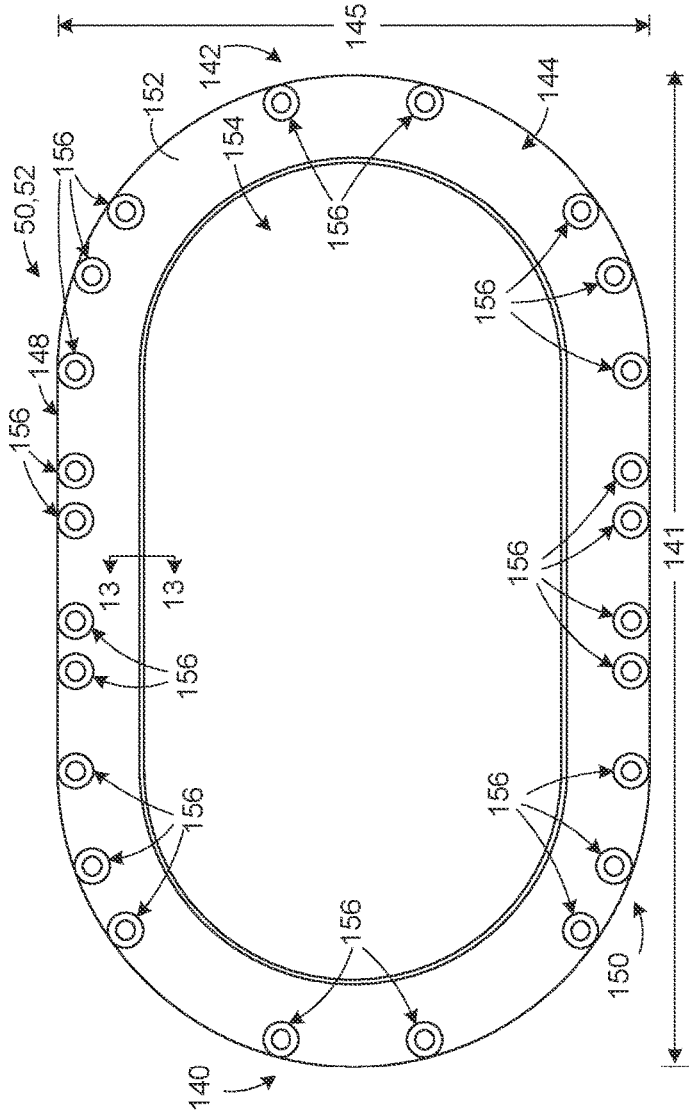
FIG. 12 is a front view of a cover of the frame of the exercise apparatus illustrated in FIG. 1.

As shown in FIGS. 12 and 13, each of the first cover 50 and the second cover 52 has a first end 140, a second end 142, a front side 144, a rear side 146, a top 148, a bottom 150, a length 141, a width 143, and a height 145, and a main body 152 that defines a passageway 154, and a plurality of attachment member passageways 156.

The length 141 extends from the first end 140 to the second end 142. The width 143 extends from the front side 144 to the rear side 146 and is substantially equal to the depth 87 of the first cover recess 86 and the depth 89 of the second cover recess 88. The height 145 extends from the top 148 to the bottom 150. In the embodiment illustrated, the length 141 is greater than the height 145 such that each of the covers 50, 52 is elongated and allows a handle to translate and rotate relative to the lengthwise axis of the exercise apparatus 10, as described herein. The passageway 154 extends from the front side 144 to the rear side 146 and is sized to receive a portion of a user's hand during use.

A set of attachment members 158 of the plurality of attachment members 54 is used to attach each of the covers 50, 52 to the housing 38. Each attachment member of the set of attachment members 158 extends through a passageway of the plurality of attachment member passageways 156 defined by a cover, in some instances through a passageway of the plurality of attachment member passageways 126 defined by a track, and is disposed within a passageway of the plurality of attachment member passageways 90 to accomplish attachment of a cover to the housing 38.

The frame passageway 56 is cooperatively defined by the housing 38, the first track member 40, the second track member 42, the third track member 44, the fourth track member 46, the first cover 50, and the second cover 52. The first handle 16 is disposed within the frame passageway 56 of the first frame 14 and can translate along the lengthwise axis 11 and rotate within the frame passageway 56. The second handle 20 is disposed within the frame passageway 56 of the second frame 18 and can translate along the lengthwise axis 11 and rotate within the frame passageway 56.

The first handle 16 is disposed within the first frame 14 between the first track member 40 (e.g., first set of ball bearings 132) and the third track member 44 (e.g., third set of ball bearings 136) and between the second track member 42 (e.g., second set of ball bearings 134) and the fourth track member 46 (e.g., fourth set of ball bearings 138). The second handle 20 is disposed within the second frame 18 between the first track member 40 (e.g., first set of ball bearings 132) and the third track member 44 (e.g., third set of ball bearings 136) and between the second track member 42 (e.g., second set of ball bearings 134) and the fourth track member 46 (e.g., fourth set of ball bearings 138). During use, the first handle 16 can translate along the length 75 of the handle passageway 72 and rotate within the handle passageway 72 of the first frame 14 and contact each ball bearing of the plurality of ball bearings 48. During use, the second handle 20 can translate along the length 75 of the handle passageway 72 and rotate within the handle passageway 72 of the second frame 18 and contact each ball bearing of the plurality of ball bearings 48.

As shown in FIGS. 16 through 19, each of the first handle 16 and the second handle 20 has a ring member 160, a handle shaft 162, and attachment members 164. The ring member 160 has a front side 168, a rear side 170, an outside diameter 169, and inside diameter 171, and a main body 172 that defines a handle shaft passageway 174, a first attachment member passageway 176, and a second attachment member passageway 178. The outside diameter 169 is less than the height 69 of the handle passageway 72 defined by the housing 38 such that the ring member 160 can be disposed, and move, within the handle passageway 72. The inside diameter 171 is sized to receive the handle shaft 162. The first and second attachment member passageways 176, 178 are coaxial with each other and each is sized to receive an attachment member 164.

The handle shaft 162 is disposed within the handle shaft passageway 174, is attached to the ring member 160, and has a handle shaft lengthwise axis 179, a handle shaft first end 180, a handle shaft second end 182, a handle shaft length 181 that extends from the handle shaft first end 180 to the handle shaft second end 182, a handle shaft outside diameter 183, and a handle shaft main body 184 that defines attachment members recesses 186. A first attachment member recess 187 extends from the handle shaft first end 180 and into the handle shaft main body 184. A second attachment member recess 188 extends from the handle shaft second end 182 and into the handle shaft main body 184. Each of the attachment member recesses 186 is sized to receive an attachment member 164 to accomplish attachment of a handle shaft 162 to a ring member 160. While the handle shaft 162 has been illustrated as extending across the entire handle shaft passageway 174, alternative embodiments can include a handle shaft that only partially extends across a handle shaft passageway.

An attachment member 164 is disposed within the first attachment member passageway 176, within the first attachment member recess 187, and is attached to the handle shaft first end 180. An attachment member 164 is disposed within the second attachment member passageway 178, within the second attachment member recess 188, and is attached to the handle shaft second end 182.

The first handle 16 is moveably attached to the first frame 14 and the second handle 20 is moveably attached to the second frame 18. In the illustrated embodiment, the first handle 16 is rotatably attached to the first frame 14 such that the first handle 16 can rotate (e.g., 360 degrees) within the frame passageway 56 of the first frame 14 and translate (e.g., along the length 75 of the handle passageway 72) relative to the first frame 14 and the lengthwise axis 11 of the exercise apparatus 10. In addition the second handle 20 is rotatably attached to the second frame 18 such that the second handle 20 can rotate (e.g., 360 degrees) within the frame passageway 56 of the second frame 18 and translate (e.g., along the length 75 of the handle passageway 72) relative to the second frame 18 and the lengthwise axis 11 of the exercise apparatus 10. However, alternative embodiments can include handles that can only partially rotate relative to a frame or a lengthwise axis of an exercise apparatus (e.g., less than 360 degrees, between 45 degrees and 315 degrees).

To assemble a frame, the first track member 40 is positioned within the first track member recess 78 such that the portion of the first track member 40 that defines the second width 115 is disposed within the first track member recess 78 and the second track member 42 is positioned within the second track member recess 80 such that the portion of the second track member 42 that defines the second width 115 is disposed within the second track member recess 80. The set of attachment members 130 is then used to attach each of the first and second track members 40, 42 to the housing 38. The first set of ball bearings 132 is then positioned within the ball bearing passageway 122 of the first track member 40 and the second set of ball bearings 134 is then positioned within the ball bearing passageway 122 of the second track member 42. Subsequently, the first cover 50 is positioned within the first cover recess 86 and the set of attachment members 158 is used to attach the first cover 50 to the housing 38 and secure the first set of ball bearings 132 between the first cover 50 and the first track member 40 and the second set of ball bearings 134 between the first cover 50 and the second track member 42.

Subsequently, a handle is positioned within the handle passageway 72. Then the third track member 44 is positioned within the third track member recess 82 such that the portion of the third track member 44 that defines the second width 115 is disposed within the third track member recess 82 and the fourth track member 46 is positioned within the fourth track member recess 84 such that the portion of the fourth track member 46 that defines the second width 115 is disposed within the fourth track member recess 84. The set of attachment members 130 is then used to attach each of the third and fourth track members 44, 46 to the housing 38. The third set of ball bearings 136 is then positioned within the ball bearing passageway 122 of the third track member 44 and the fourth set of ball bearings 138 is then positioned within the ball bearing passageway 122 of the fourth track member 46. Subsequently, the second cover 52 is positioned within the second cover recess 88 and the set of attachment members 158 is used to attach the second cover 52 to the housing 38 and secure the third set of ball bearings 136 between the second cover 52 and the third track member 44 and the fourth set of ball bearings 138 between the second cover 52 and the fourth track member 46.

In the embodiment illustrated, the second shaft 22 is attached to the first frame 14 and the third shaft 24 is attached to the second frame 18. As best shown in FIGS. 1, 2, 6, 20, and 21, each of the second shaft 22 and the third shaft 24 has an elongate member 190, a support member 192 rotatably attached to the elongate member 190, and an attachment member 194. The support member 192 is rotatably attached to the elongate member 190 such that the support member 192 can rotate relative to the elongate member 190 during use. However, alternative embodiments can include a support member that is fixedly attached to an elongate member such that it cannot rotate relative to the elongate member during use.

The elongate member 190 has a first end 196, a second end 198, an outside diameter 197, a length 199, and a main body 202 that defines an attachment member recess 204. The attachment member recess 204 extends from the second end 198 toward the first end 196 and is sized to receive a portion of the attachment member 194.

Figure 20:
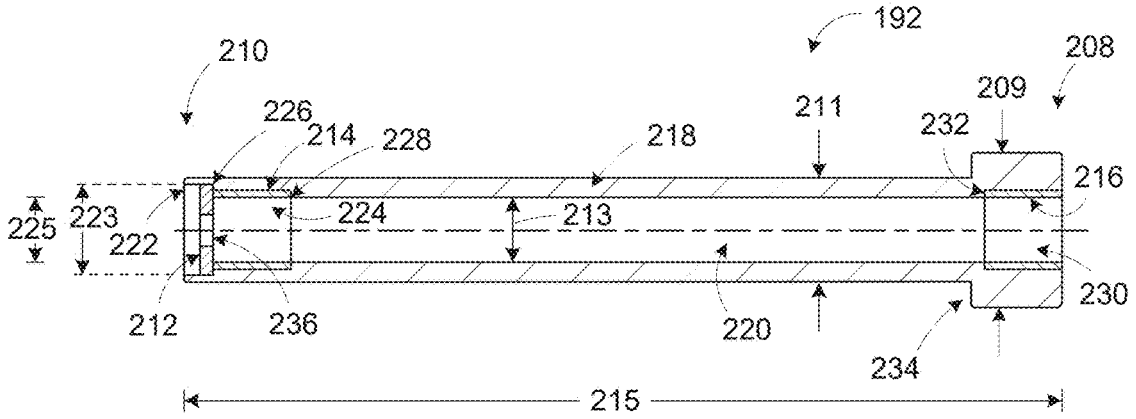
FIG. 20 is a sectional view of a shaft of the exercise apparatus illustrated in FIG. 1.
Figure 21:
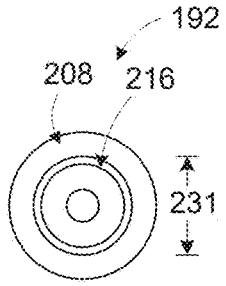
FIG. 21 is an end view of a shaft of the exercise apparatus illustrated in FIG. 1.

In the illustrated embodiment, as shown in FIGS. 20 and 21, the support member 192 has a first end 208, a second end 210, a first outside diameter 209, a second outside diameter 211, a length 215, a plate member 212, a first bearing 214 (e.g., sleeve bearing), a second bearing 216 (e.g., sleeve bearing), and a main body 218 that defines a passageway 220, a first recess 222, a second recess 224, a first shoulder 226, a second shoulder 228, a third recess 230, a third shoulder 232, and a fourth shoulder 234. The passageway 220 extends from the first end 208 to the second end 210 and has an inside diameter 213. The inside diameter 213 of the support member 192 is greater than the outside diameter 197 of the elongate member 190 such that the elongate member 190 can be partially disposed within the passageway 214. The length 215 of the support member 192 is less than the length 199 of the elongate member 190.

The first recess 222 extends from the second end 210 toward the first end 208 and has an inside diameter 223 that is greater than the inside diameter 213 of the passageway 220. The second recess 224 extends from the first recess 222 toward the first end 208 and has an inside diameter 225 that is less than the inside diameter 223 of the first recess 222 and greater than the inside diameter 213 of the passageway 220. The first shoulder 226 is defined at the transition between the inside diameter 223 of the first recess 222 and the inside diameter 225 of the second recess 224. The second shoulder 228 is defined at the transition between the inside diameter 225 of the second recess 224 and the inside diameter 213 of the passageway 220. The third recess 230 extends from the first end 208 toward the second end 210 and has an inside diameter 231 that is greater than the inside diameter 213 of the passageway 220. The third shoulder 232 is defined at the transition between the inside diameter 231 of the third recess 230 and the inside diameter 213 of the passageway 220. The fourth shoulder 234 is defined at the transition between the first outside diameter 209 and the second outside diameter 211. The fourth shoulder 234 provides a mechanical stop to advancement of a weight (e.g., barbell weight) onto the support member 192.

The plate member 212 is attached to the support member 192 and is disposed within the first recess 222 adjacent to the first shoulder 226. The plate member 212 provides structure for accomplishing attachment of the support member 192 to the elongate member 190. The plate member 212 defines a passageway 236 that is sized to receive a portion of the attachment member 194. The first bearing 214 is disposed within the second recess 224 between the plate member 212 and the second shoulder 228 and provides a mechanism for maintaining rotational movement of the support member 192 relative to the elongate member 190. The second bearing 216 is disposed within the third recess 230 adjacent to the third shoulder 232 and provides a mechanism for maintaining rotational movement of the support member 192 relative to the elongate member 190. Any suitable type of bearing can be used in an exercise apparatus. To accomplish attachment of a support member 192 to an elongate member 190, the elongate member 190 is passed into the passageway 220 defined by the support member 192 from the first end 208 of the support member 192 until the elongate member 190 contacts the plate member 212. Subsequently, the attachment member 194 is passed through the passageway 236 defined by the plate member 212 and into the attachment member recess 204 of the elongate member 190.

The exercise apparatuses described herein allow for dynamic movement of the handles 16, 20 relative to the frames 14, 18 and/or provide for rotation of the handles 16, 20 relative to the fames 14, 18 while the exercise apparatus is being used to relieve excessive stresses on a user's shoulders and surrounding soft tissues. For example, the exercise apparatuses described herein allow for a bench press maneuver to be performed in a more physiological motion in regards to shoulder joint mechanics as opposed to current exercise apparatuses (e.g., bench press bars that are fixed and don't allow for translation or rotation, as described herein), which can diminish the risk of shoulder injury from excessive repetitions. The exercise apparatuses described herein can be used not only in standard weight training activities but also for shoulder and/or pectoral rehabilitation following non-surgical injuries and/or for rehabilitation following shoulder and/or pectoral ligament repair and/or reconstruction.

The first shaft 12, the first frame 14, the first handle 16, the second frame 18, the second handle 20, the second shaft 22, and the third shaft 24 included in an exercise apparatus 10 can be formed of any suitable material and manufactured using any suitable technique or method of manufacture. Selection of a suitable material and technique or method of manufacture can be based on various considerations, including the structural arrangement of the exercise apparatus of which the feature is a component. Examples of materials considered suitable to form a first shaft, a first frame, a first handle, a second frame, a second handle, a second shaft, a third shaft, and the components thereof include wood, polymers, plastics, metals, steel, stainless steel, carbon steel, aluminum, combinations of the materials described herein, and any other material considered suitable for a particular embodiment. Examples of techniques and methods of manufacture considered suitable to form a first shaft, a first frame, a first handle, a second frame, a second handle, a second shaft, a third shaft, and the components thereof include injection molding, casting, cold rolling, laser cutting, finish machining, punching, and any other technique or method considered suitable for a particular embodiment. While the exercise apparatus 10 has been illustrated as including a particular number of shafts, frames, handles, covers, track members, and attachment members and being assembled such that a shaft, frame, and handle is disposed on a lengthwise axis of an exercise apparatus, an exercise apparatus can include any suitable number of shafts, frames, handles, covers, track members, and/or attachment members disposed at any suitable location relative to one another (e.g., offset relative to a lengthwise axis of an exercise apparatus).

Any suitable technique or method of attaching the components described herein as being attached can be utilized and selection of a suitable technique or method can be based on various considerations, including the material that forms the components intended to be attached to one another. For example, while the various attachment members described herein have been illustrated as threaded members, other types of attachment members can be utilized. Examples of techniques and methods of attachment considered suitable between two components of an exercise apparatus include using snap-fit connections, using threaded members, adhesives, fusing, welding, and any other technique or method considered suitable for a particular embodiment. Alternative embodiments can optionally include releasable attachments between components described as attached to one another herein. For example, a first frame and/or second frame can be releasably attached to a first shaft, a second shaft, and/or a third shaft and/or include an attachment that allows for movement of a first frame and/or a second frame relative to a first shaft, a second shaft, and/or a third shaft.

While the first shaft 12, the first frame 14, the first handle 16, the second frame 18, the second handle 20, the second shaft 22, and the third shaft 24 have been illustrated as having a particular structural arrangement, a first shaft, a first frame, a first handle, a second frame, a second handle, a second shaft, and a third shaft included in an exercise apparatus can have any suitable structural arrangement and selection of a suitable structural arrangement can be based on various considerations, including the intended use of the exercise apparatus. For example, an exercise apparatus can have a structural arrangement that allows for an Olympic sized bench press barbell to be positioned on a second shaft and/or a third shaft. In addition, an exercise apparatus can be utilized with a fixed handle hammer strength or Nautilus piece of equipment.

Figure 22:
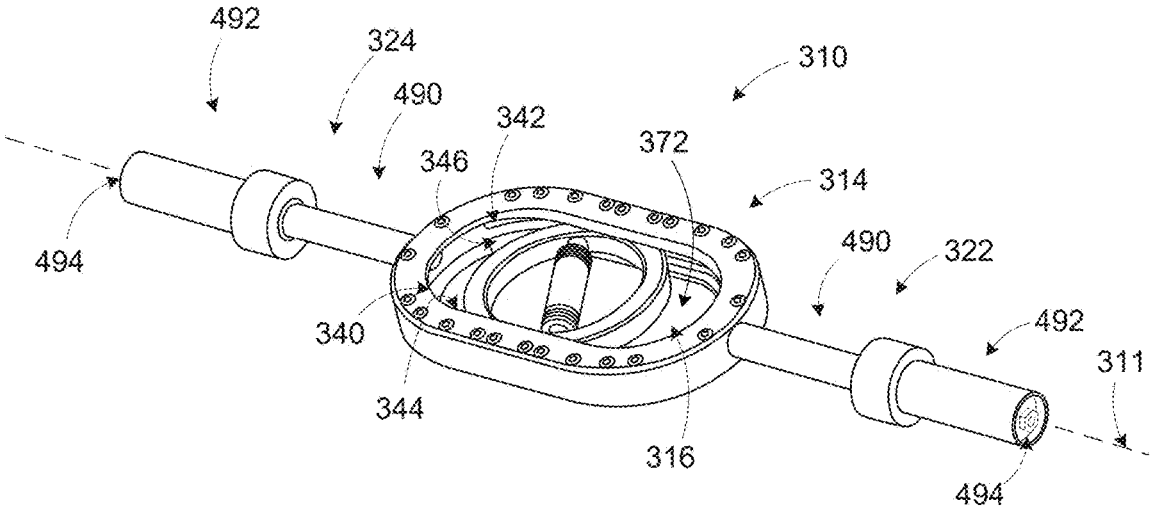
FIG. 22 is a perspective view of another example exercise apparatus.

FIG. 22 illustrates another example exercise apparatus 310. The exercise apparatus 310 is similar to the exercise apparatus 10 illustrated in FIGS. 1 through 21 described above, except as detailed below. In the illustrated embodiment, the exercise apparatus 310 has a lengthwise axis 311 and includes a first frame 314, a first handle 316 attached, and moveable relative, to the first frame 314, a first shaft 322 attached to the first frame 314, and a second shaft 324 attached to the first frame 314.

In the embodiment illustrated, the first frame 314 is disposed between, and attached to, the first shaft 322 and the second shaft 324. The first handle 316 is disposed within the first frame 314 between the first track member 340 and the third track member 344 and between the second track member 342 and the fourth track member 346. The first handle 316 is attached to the first frame 314 such that the first handle 316 can partially rotate (e.g., 180 degrees) and translate (e.g., along the length of the handle passageway 372) relative to the first frame 314 and the lengthwise axis 311 of the exercise apparatus 310. However, alternative embodiments can include handles that can only partially rotate relative to a frame or a lengthwise axis of an exercise apparatus within a range between about 45 degrees and about 180 degrees.

The first shaft 322 is attached to the first frame 314 and the second shaft 324 is attached to the first frame 314. Each of the first shaft 322 and the second shaft 324 has an elongate member 490, a support member 492 attached to the elongate member 490, and an attachment member 494. The support member 492 is fixedly attached to the elongate member 490 such that the support member 492 is unable to rotate relative to the elongate member 490 during use.

FIGS. 23 through 27 illustrate another example exercise apparatus 510. The exercise apparatus 510 has a lengthwise axis 511 and includes a first frame 514 and a first handle 516 attached, and moveable relative, to the first frame 514.

The first frame 514 includes a housing 538, a first track member 540, a second track member 542, a plurality of ball bearings 548, a first cover 550, a second cover 552, a plurality of attachment members 554, and defines a frame passageways 556. The first track member 540 is disposed between the first cover 550 and the housing 538 and the second track member 542 is disposed between the second cover 552 and the housing 538.

Figure 23:
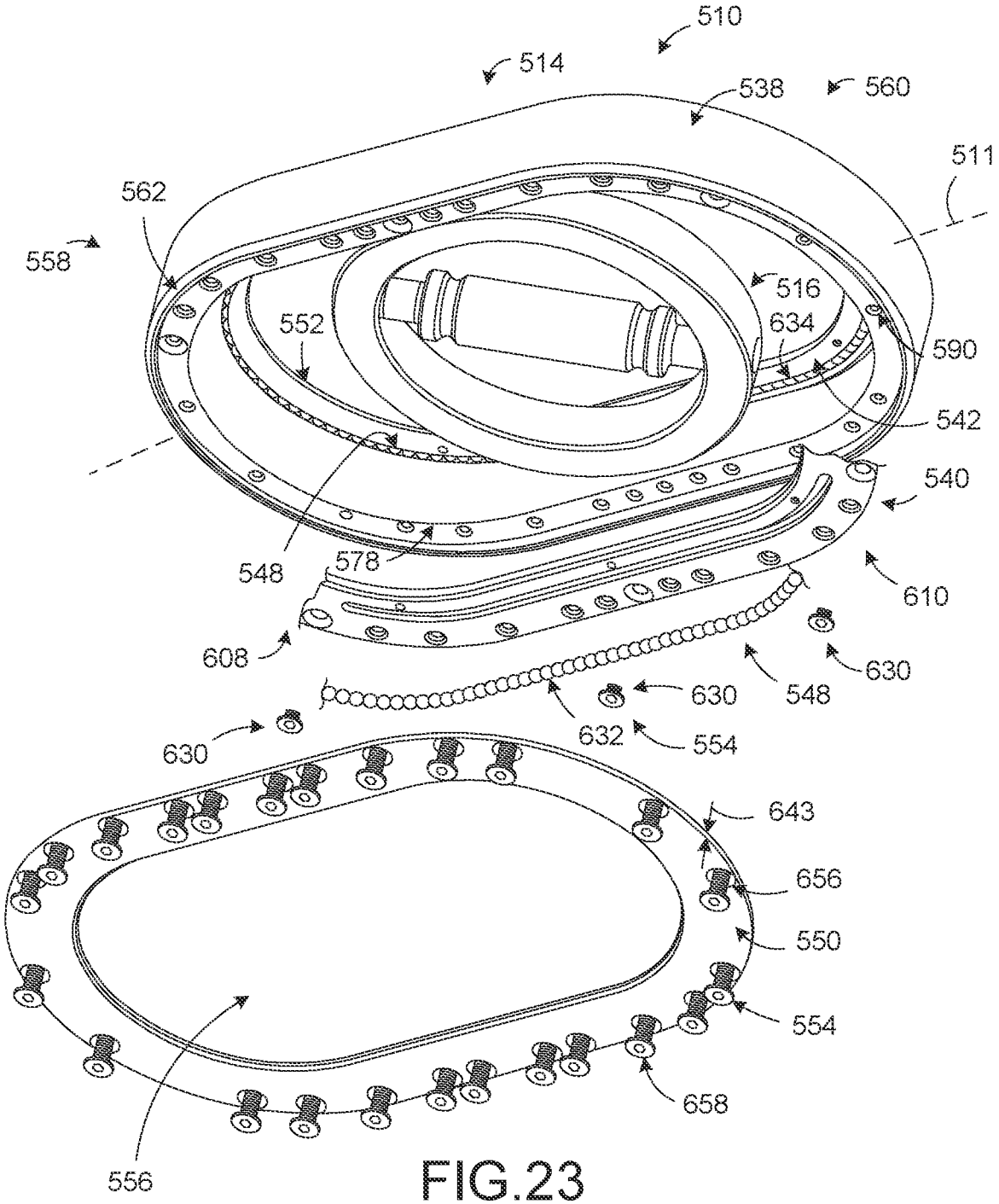
FIG. 23 is an exploded partial perspective view of another example exercise apparatus.
Figure 25:
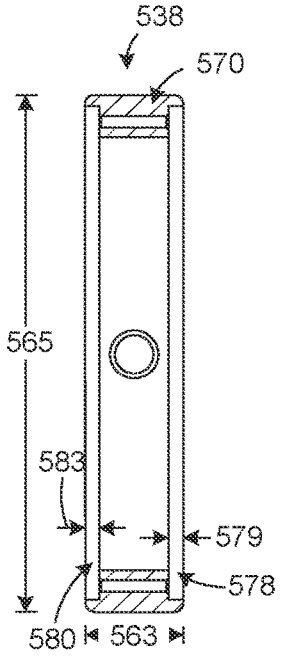
FIG. 25 is a cross-sectional view of the housing illustrated in FIG. 24 taken along line 25-25.
Figure 24:
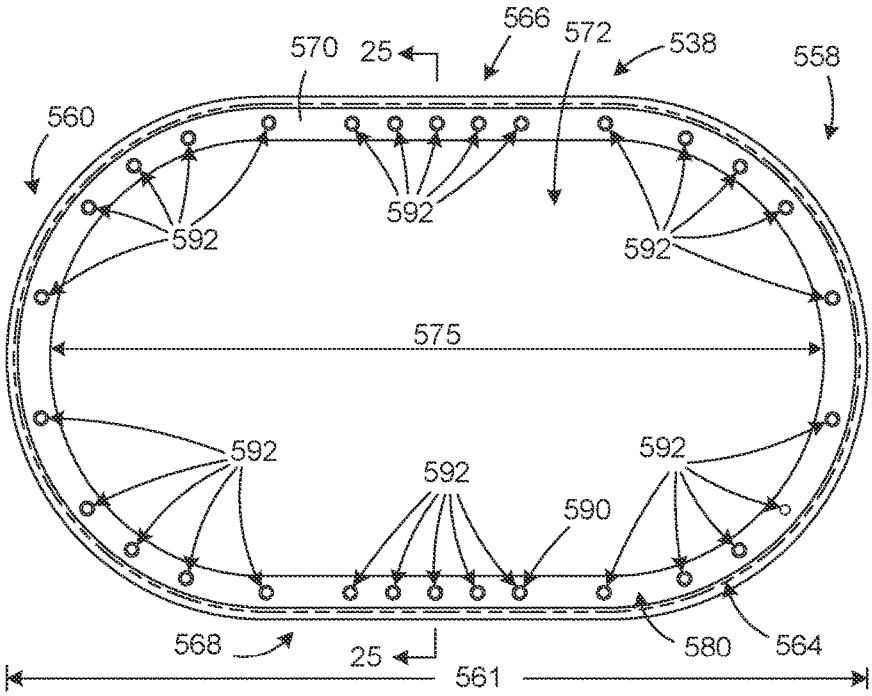
FIG. 24 is a rear view of a housing of the frame of the exercise apparatus illustrated in FIG. 23.

As shown in FIGS. 23 through 25, the housing 538 has a first end 558, a second end 560, a front side 562, a rear side 564, a top 566, a bottom 568, a length 561, a width 563, and a height 565, and a main body 570 that defines a handle passageway 572, a first track member recess 578, a second track member recess 580, and a plurality of attachment member passageways 590.

The first track member recess 578 extends from the front side 562 toward the rear side 564 a depth 579 and along the entire enclosed boundary of the handle passageway 572. The second track member recess 580 extends from the rear side 564 toward the front side 562 a depth 583 and along the entire enclosed boundary of the handle passageway 572. The depth 579 of the first track member recess 578 and the depth 583 of the second track member recess 580 is greater than a second width 615 of a track member and sized to receive a track member and a cover, as described in more detail herein. In the illustrated embodiment, the depth 579 of each of the first track member recess 578 and the depth 583 of the second track member recess 580 is substantially equal to the sum of the second width 615 of a track member and the width 643 of a cover. Each attachment member passageway of the plurality of attachment member passageways 590 extends from the first track member recess 578 to the second track member recess 580.

Figure 27:
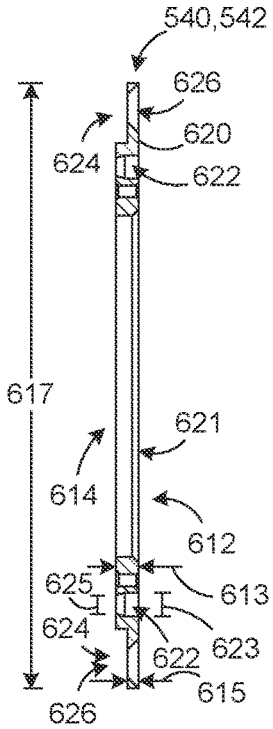
FIG. 27 is a cross-sectional view of the track member illustrated in FIG. 26 taken along line 27-27.
Figure 26:
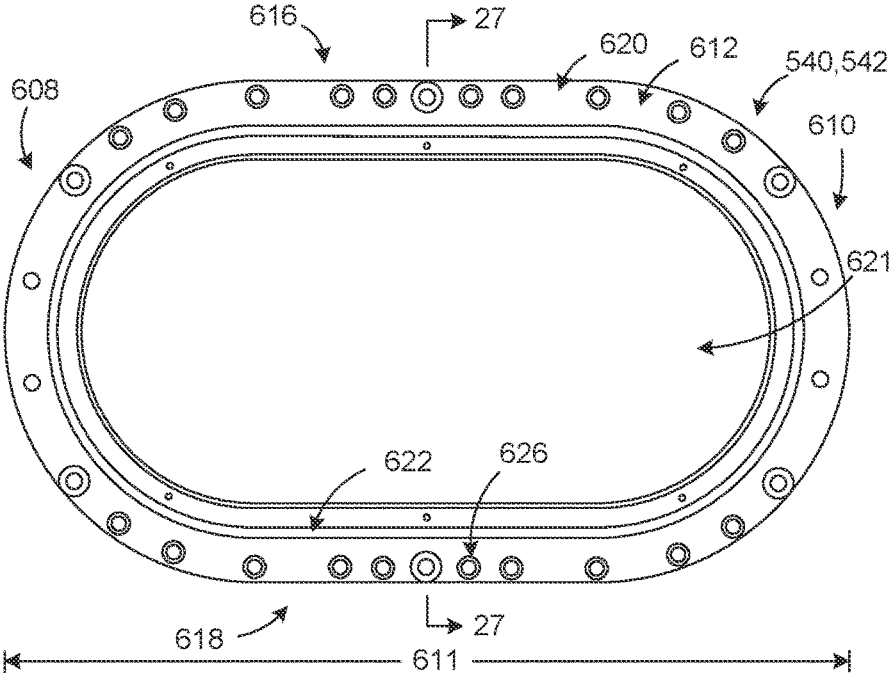
FIG. 26 is a front view of a track member of the frame of the exercise apparatus illustrated in FIG. 23.

In the illustrated embodiment, and as shown in FIGS. 23, 26, and 27, each of the first track member 540 and the second track member 542 has a first end 608, a second end 610, a front side 612, a rear side 614, a top 616, a bottom 618, a length 611, a first width 613, a second width 615, a height 617, and a main body 620 that defines a central passageway 621, a ball bearing passageway 622, a housing recess 624, and a plurality of attachment member passageways 626. As shown in FIG. 26, each of the first track member 540 and the second track member 542 is an oval member.

The ball bearing passageway 622 extends from the front side 612 to the rear side 614, has an oval shape, and is disposed between the central passageway 621 and the housing recess 624 such that it has direct access to the handle passageway 572 defined by the housing 538 when the exercise apparatus 510 is assembled. The ball bearing passageway 622 is sized to receive a set of ball bearings of the plurality of ball bearings 548, as described herein. The ball bearing passageway 622 has a first width 623 at the front side 612 and a second width 625 at the rear side 614 that is less than the first width 623. This structural configuration provides a mechanism for maintaining a set of ball bearings of the plurality of ball bearings 548 between a track member and a cover such that a portion of each ball bearing of the set of ball bearings is partially disposed outside of the ball bearing passageway 622, within the handle passageway 572, and can contact a handle.

The housing recess 624 extends from the rear side 614 toward the front side 612 and extends from an outer surface toward an inner surface such that it terminates prior to the ball bearing passageway 622. The housing recess 624 is sized to receive a portion of the housing 538 such that the ball bearing passageway 622 has direct access to the handle passageway 572 when the exercise apparatus 510 is assembled (e.g., an axis extending through the center of the ball bearing passageway 622 extends into the handle passageway 572).

Each passageway of the plurality of attachment member passageways 626 is sized to receive a portion of an attachment member of the plurality of attachment members 554. Each passageway of the plurality of attachment member passageways 626 extends from the front side 612 to the housing recess 624. When assembled, the plurality of attachment member passageways 626 of the first track member 540 are coaxial with the first set of passageways 592 of the plurality of attachment member passageways 590 defined by the housing 538. When assembled, the plurality of attachment member passageways 626 of the second track member 542 are coaxial with the first set of passageways 592 of the plurality of attachment member passageways 590 defined by the housing 38.

A set of attachment members 630 of the plurality of attachment members 554 is used to attach each of the track members 540, 542 to the housing 538. Each attachment member of the set of attachment members 630 extends through a passageway of the plurality of attachment member passageways 626 and is disposed within a passageway of the plurality of attachment member passageways 590 to accomplish attachment of a track to the housing 538.

A first set of ball bearings 632 of the plurality of ball bearings 548 is moveably disposed within the ball bearing passageway 622 of the first track member 540 and between the first track member 540 and the first cover 550. A second set of ball bearings 634 of the plurality of ball bearings 548 is moveably disposed within the ball bearing passageway 622 of the second track member 542 and between the second track member 542 and the second cover 552. Each ball bearing of the plurality of ball bearings 548 is sized such that a portion of each ball is partially disposed outside of the ball bearing passageway 622, within the handle passageway 572, and can contact a handle during use.

A set of attachment members 658 of the plurality of attachment members 554 is used to attach each of the covers 550, 552 to the housing 538. Each attachment member of the set of attachment members 658 extends through a passageway of the plurality of attachment member passageways 656 defined by a cover, through a passageway of the plurality of attachment member passageways 626 defined by a track, and is disposed within a passageway of the plurality of attachment member passageways 590 to accomplish attachment of a cover to the housing 538.

The frame passageway 556 is cooperatively defined by the housing 538, the first track member 540, the second track member 542, the first cover 550, and the second cover 552. The first handle 516 is disposed within the frame passageway 556 of the first frame 514 and can translate along the lengthwise axis 511 and rotate within the frame passageway 556. The first handle 516 is disposed within the first frame 514 between the first track member 540 (e.g., first set of ball bearings 632) and the second track member 542 (e.g., second set of ball bearings 634). During use, the first handle 516 can translate along the length 575 of the handle passageway 572 and rotate within the handle passageway 572 of the first frame 514 and contact each ball bearing of the plurality of ball bearings 548. In the illustrated embodiment, the first handle 516 is moveably attached to the first frame 514 such that the first handle 516 can rotate (e.g., 360 degrees) and translate relative to the first frame 514 and the lengthwise axis 511 of the exercise apparatus 510.

To assemble a frame, the first track member 540 is positioned within the first track member recess 578 such that the portion of the first track member 540 that defines the second width 615 is disposed within the first track member recess 578. The set of attachment members 630 is then used to attach the first track member 540 to the housing 538. The first set of ball bearings 632 is then positioned within the ball bearing passageway 622 of the first track member 540. Subsequently, the first cover 550 is positioned within the first track member recess 578 and the set of attachment members 658 is used to attach the first cover 550 to the housing 538 and secure the first set of ball bearings 632 between the first cover 550 and the first track member 540.

Subsequently, the handle 516 is positioned within the handle passageway 572. Then the second track member 542 is positioned within the second track member recess 580 such that the portion of the second track member 542 that defines the second width 615 is disposed within the second track member recess 580. The set of attachment members 630 is then used to attach the second track member 542 to the housing 538. The second set of ball bearings 634 is then positioned within the ball bearing passageway 622 of the second track member 542. Subsequently, the second cover 552 is positioned within the second track member recess 580 and the set of attachment members 658 is used to attach the second cover 552 to the housing 538 and secure the second set of ball bearings 634 between the second cover 552 and the second track member 542.

The exercise apparatus 510 illustrated in FIGS. 23 through 27 can include additional weight such that it can be used independent of any other exercise apparatus. Alternatively, an exercise apparatus, such as the exercise apparatus 510 illustrated in FIGS. 23 through 27, can include an eyelet or other structure (e.g., on the top of a housing) such that the first frame can be releasably attached to a separate component (e.g., wire of a wire lift machine).

FIGS. 28 through 38 illustrate another example exercise apparatus 710. The exercise apparatus 710 is similar to the exercise apparatus 10 illustrated in FIGS. 1 through 21 described above, except as detailed below. The exercise apparatus 710 has a lengthwise axis 711 and includes a first shaft 712, a first frame 714 attached to the first shaft 712, a first handle 716 attached, and moveable relative, to the first frame 714, a second frame 718 attached to the first shaft 712, a second handle 720 attached, and moveable relative, to the second frame 718, a second shaft 722 attached to the first frame 714, a third shaft 724 attached to the second frame 718, a first elongate bar 790, a second elongate bar 792, a first locking member 794, and a second locking member 796.

Figure 34:
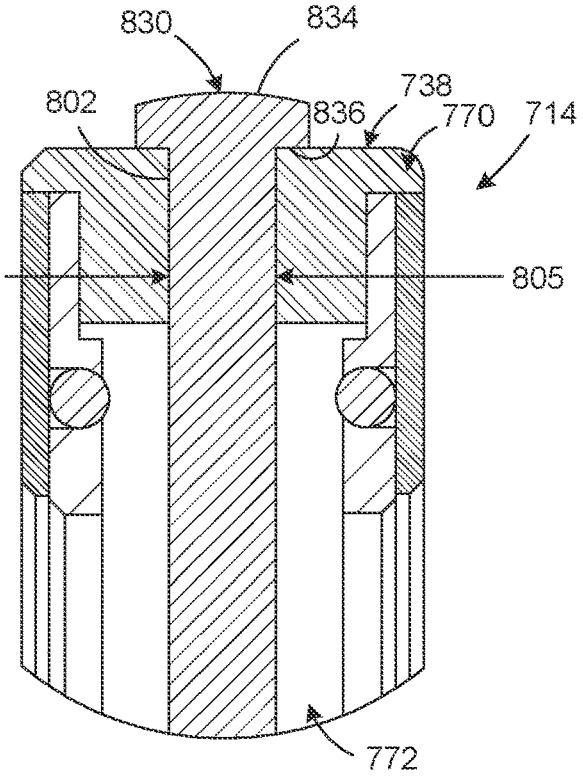
FIG. 34 is a cross-sectional view of the first frame shown in FIG. 32 taken along line 34-34.
Figure 35:
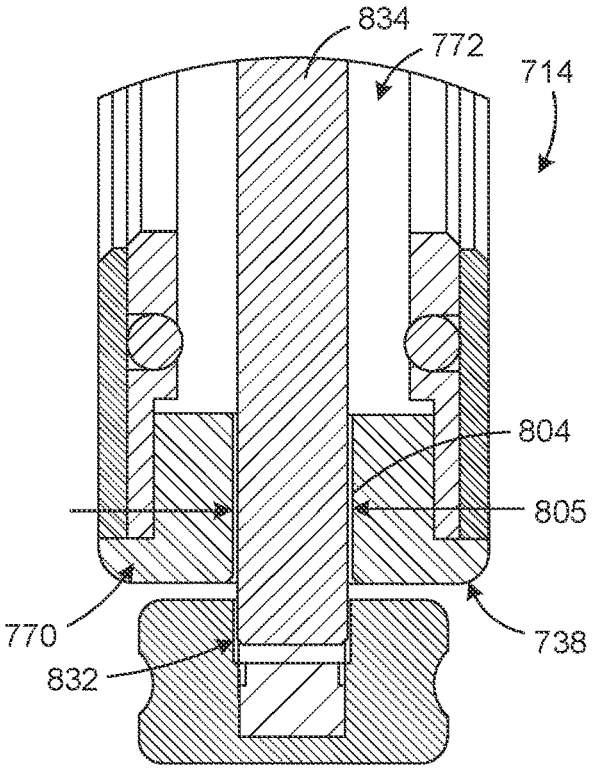
FIG. 35 is a cross-sectional view of the first frame shown in FIG. 32 taken along line 35-35.

As best shown in FIGS. 28 through 31, the housing 738 of each of the first frame 714 and the second frame 718 has a main body 770 that defines a handle passageway 772, a first set of bar passageways 802, and a second set of bar passageways 804. Each passageway in the first set of bar passageways 802 extends from the top 766 to the handle passageway 772. Each passageway in the second set of bar passageways 804 extends from the bottom 768 to the handle passageway 772. In the illustrated embodiment, the first set of bar passageways 802 includes a first bar passageway 806, a second bar passageway 808, a third bar passageway 810, and a fourth bar passageway 812 and the second set of bar passageways 804 includes a first bar passageway 814, a second bar passageway 816, a third bar passageway 818, and a fourth bar passageway 820. However, alternative embodiments of a frame can include any suitable number of bar passageways. The first bar passageway 806 in the first set of bar passageways 802 is coaxial with the first bar passageway 814 in the second set of bar passageways 804. The second bar passageway 808 in the first set of bar passageways 802 is coaxial with the second bar passageway 816 in the second set of bar passageways 804. The third bar passageway 810 in the first set of bar passageways 802 is coaxial with the third bar passageway 818 in the second set of bar passageways 804. The fourth bar passageway 812 in the first set of bar passageways 802 is coaxial with the fourth bar passageway 820 in the second set of bar passageways 804. Each bar passageway in the first set of bar passageways 802 and the second set of bar passageways 804 has a diameter 805, as shown in FIG. 34, and is sized to receive an elongate bar, as described in more detail herein.

Figure 36:
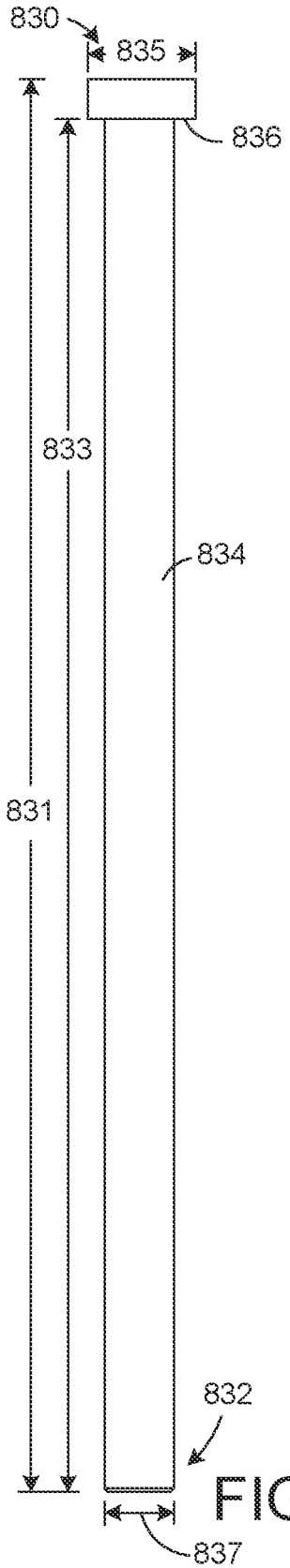
FIG. 36 is a front view of an elongate bar of the exercise apparatus illustrated in FIG. 28.

The first elongate bar 790 is disposed through the first frame 714 and prevents the first handle 716 from translating along the length 775 of the handle passageway 772 of the first frame 714. The second elongate bar 792 is disposed through the second frame 718 and prevents the second handle 720 from translating along the length 775 of the handle passageway 772 of the second frame 718. As best shown in FIG. 36, each of the first elongate bar 790 and the second elongate bar 792 has a first end 830, a second end 832, a first length 831, a second length 833, a first width 835, a second width 837, a main body 834 that defines a shoulder 836, and is formed of a first material. The first length 831 extends from the first end 830 to the second end 832 and is greater than the height 765 of a frame. The second length 833 extends from the shoulder 836 to the second end 832 and is greater than the height 765 of a frame. The first width 833 is greater than the second width 835 and greater than the diameter 805 of a bar passageway. The shoulder 836 is defined between the first end 830 and the second end 832 and provides a mechanical stop to advancement of a bar member through a bar passageway.

Figure 28:
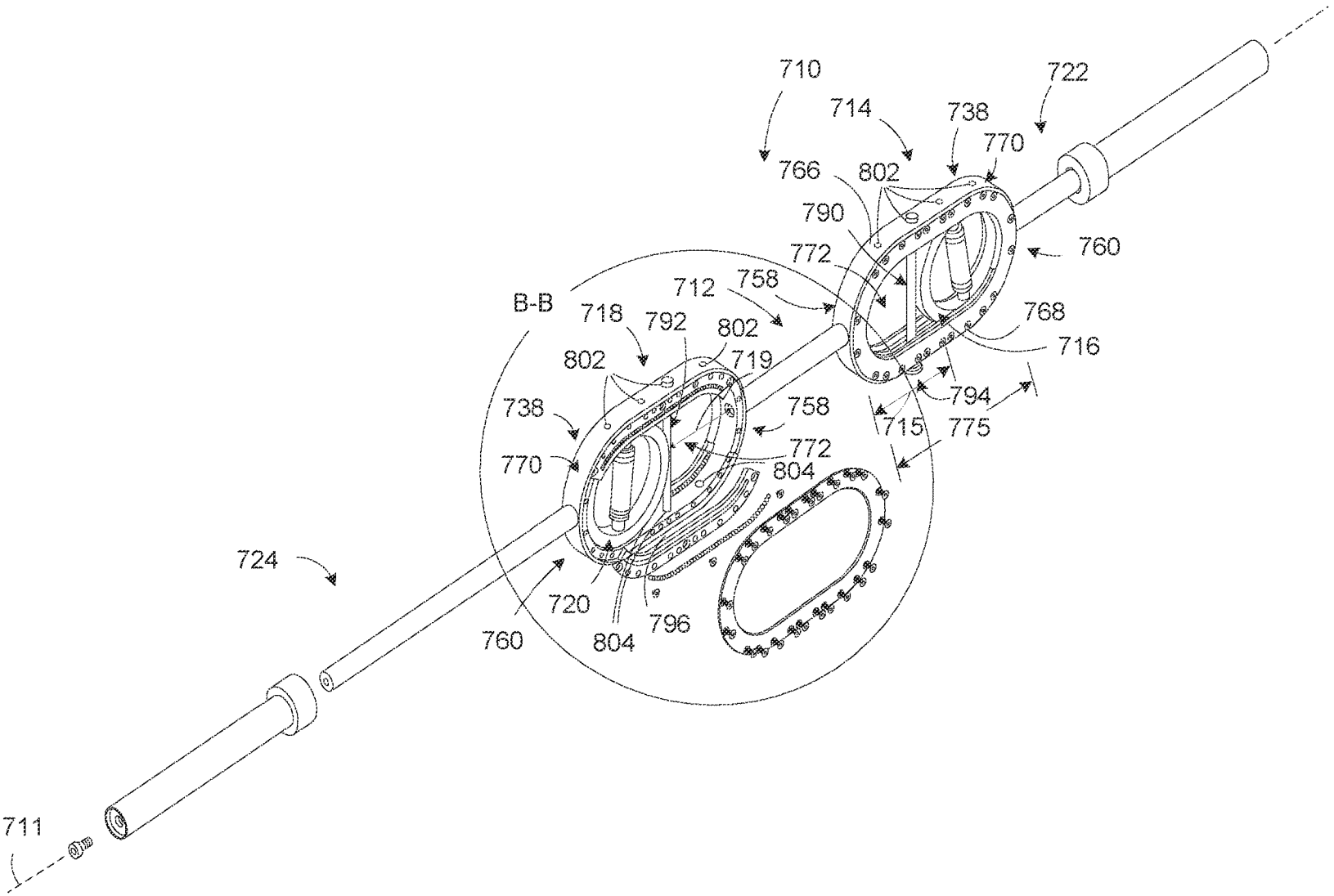
FIG. 28 is a partially exploded perspective view of another exercise apparatus. The first elongate bar is in the second position and the second elongate bar is in the second position.
Figure 29:
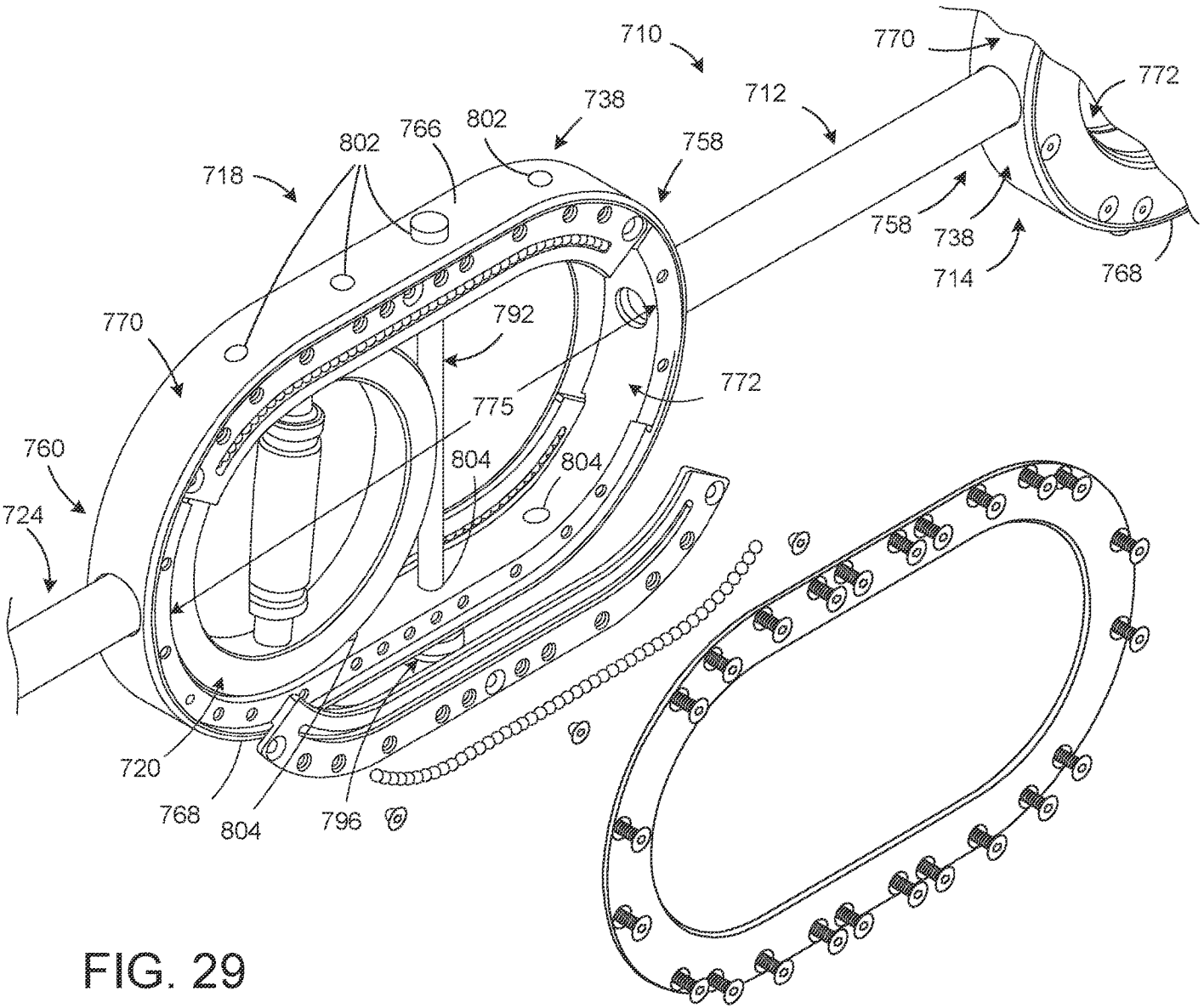
FIG. 29 is a magnified view of area B-B in FIG. 28.
Figure 30:
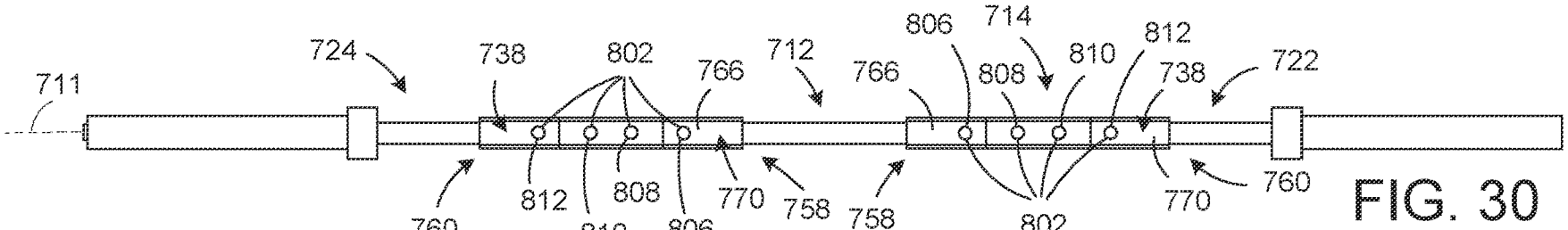
FIG. 30 is a top view of the first shaft, the first frame, the second frame, the second shaft, and the third shaft of the exercise apparatus illustrated in FIG. 28. The first and second elongate bars have been omitted for clarity.
Figure 31:
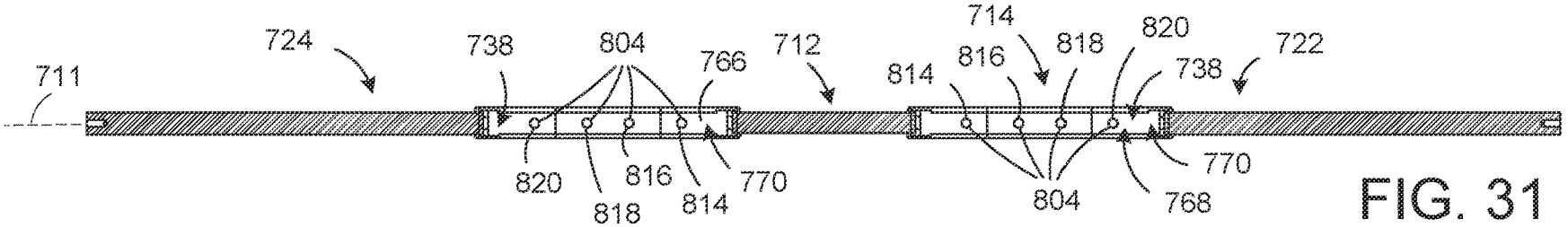
FIG. 31 is a cross-sectional view of the first shaft, the first frame, the second frame, the second shaft, and the third shaft of the exercise apparatus illustrated in FIG. 28 taken along the lengthwise axis of the exercise apparatus.

As shown in FIG. 28, the first elongate bar 790 is disposed in a second position and the second elongate bar 792 is disposed in the second position. In the second position, the first elongate bar 790 extends through the second bar passageway 808 in the first set of bar passageways 802 of the first frame 714 and the second bar passageway 816 in the second set of bar passageways 804 of the first frame 714. In the second position, the second elongate bar 792 extends through the second bar passageway 808 in the first set of bar passageways 802 of the second frame 718 and the second bar passageway 816 in the second set of bar passageways 804 of the second frame 718. Positioning the first elongate bar 790 in the second position on the first frame 714 positions the first handle 716 between the first elongate bar 790 and the second end 760 of the housing 738. Positioning the second elongate bar 792 in the second position on the second frame 718 positions the second handle 720 between the second elongate bar 792 and the second end 760 of the housing 738.

While the illustrated embodiment shows a first elongate bar 790 and a second elongate bar 792, an exercise apparatus can include any suitable number of elongate bars to prevent translation of a handle within a handle passageway. Examples of numbers of elongate bars to include in an exercise apparatus include one, two, three, four, five, six, more than six, and any other number considered suitable for a particular embodiment. While the illustrated embodiment shows the first and second elongate bars 790, 792 in particular positions, an elongate bar can be located in any suitable position to achieve a desired fitness activity.

Figure 32:
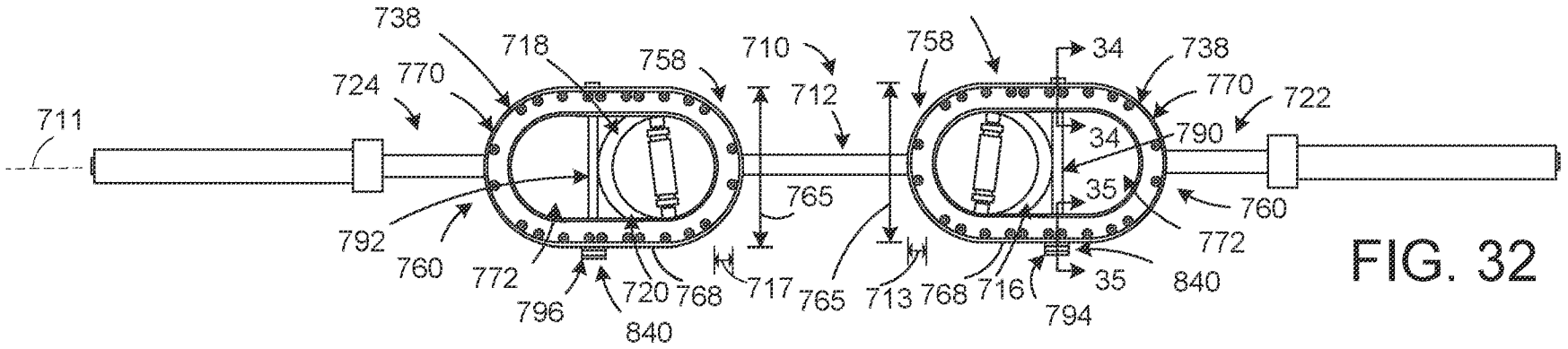
FIG. 32 is a front view of the exercise apparatus illustrated in FIG. 28. The first elongate bar is in the third position and the second elongate bar is in the third position.

For example, as shown in FIG. 32, the first elongate bar 790 can be disposed in a third position and the second elongate bar 792 can be disposed in a third position. In the third position, the first elongate bar 790 extends through the third bar passageway 810 in the first set of bar passageways 802 of the first frame 714 and the third bar passageway 818 in the second set of bar passageways 804 of the first frame 714. In the third position, the second elongate bar 792 extends through the third bar passageway 810 in the first set of bar passageways 802 of the second frame 718 and the third bar passageway 818 in the second set of bar passageways 804 of the second frame 718. Positioning the first elongate bar 790 in the third position on the first frame 714 positions the first handle 716 between the first elongate bar 790 and the first end 758 of the housing 738. Positioning the second elongate bar 792 in the third position on the second frame 718 positions the second handle 720 between the second elongate bar 792 and the first end 758 of the housing 738.

Figure 33:
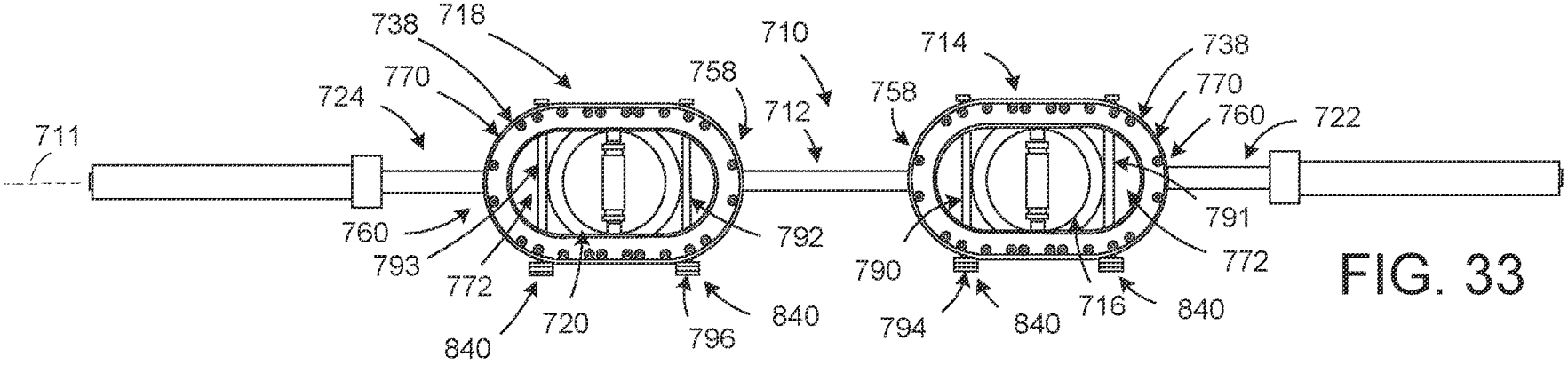
FIG. 33 is a front view of the exercise apparatus illustrated in FIG. 28. The first elongate bar is in the first position, the second elongate bar is in the first position, the third elongate bar is in the fourth position, and the fourth elongate bar is in the fourth position.

Furthermore, as shown in FIG. 33, the first elongate bar 790 can be disposed in a first position, the second elongate bar 792 can be disposed in a first position, a third elongate bar 791 can be disposed in a fourth position, and a fourth elongate bar 793 can be disposed in a fourth position. In the first position, the first elongate bar 790 extends through the first bar passageway 806 in the first set of bar passageways 802 of the first frame 714 and the first bar passageway 814 in the second set of bar passageways 804 of the first frame 714. In the fourth position, the third elongate bar 791 extends through the fourth bar passageway 812 in the first set of bar passageways 802 of the first frame 712 and the fourth bar passageway 820 in the second set of bar passageways 804 of the first frame 712. In the first position, the second elongate bar 792 extends through the first bar passageway 806 in the first set of bar passageways 802 of the second frame 718 and the first bar passageway 814 in the second set of bar passageways 804 of the second frame 718. In the fourth position, the fourth elongate bar 793 extends through the fourth bar passageway 812 in the first set of bar passageways 802 of the second frame 718 and the fourth bar passageway 820 in the second set of bar passageways 804 of the second frame 718. Positioning the first elongate bar 790 in the first position and the third elongate bar 791 in the fourth position on the first frame 714 positions the first handle 716 between the first elongate bar 790 and the third elongate bar 791. Positioning the second elongate bar 792 in the first position and the fourth elongate bar in the fourth position on the second frame 718 positions the second handle 720 between the second elongate bar 792 and the fourth elongate bar 793. Alternative embodiments can also include positioning a first elongate bar in first position or fourth position on a first frame without including a third elongate bar and/or positioning a second elongate bar in a first position or fourth position on a second frame without including a fourth elongate bar such that translation within a handle passageway is reduced relative to embodiments that do not include an elongate bar.

FIGS. 28 through 38 illustrate movement (e.g., translation) of the first handle 716 and second handle 718 along the lengthwise axis 711. As shown in FIGS. 28 and 32, the first handle 716 is moveable along the lengthwise axis 711 of the exercise apparatus 710 and between a first position, as shown in FIG. 32, in which the first handle 716 is disposed a first distance 713 from the first shaft 712, or the first end 758 of the housing 738, and a second position, as shown in FIG. 28, in which the first handle 716 is disposed a second distance 715 from the first shaft 712, or the first end 758 of the housing 738, that is greater than the first distance 713. As shown in FIGS. 28 and 32, the second handle 718 is moveable along the lengthwise axis 711 of the exercise apparatus 710 and between a third position, as shown in FIG. 32, in which the second handle 718 is disposed a third distance 717 from the first shaft 712, or the first end 758 of the housing 738, and a fourth position, as shown in FIG. 28, in which the second handle 718 is disposed a fourth distance 719 from the first shaft 712, or the first end 758 of the housing 738, that is greater than the third distance 717. In embodiments in which an elongate bar is not disposed through a frame passageway, a handle can move, or translate, along the lengthwise axis of an exercise apparatus an entire length of the handle passageway. Alternatively, in embodiments in which an elongate bar is disposed through a frame passageway, a handle can move, or translate, along the lengthwise axis a portion of a length of the handle passageway, or be fixed along the lengthwise axis and length of the handle passageway (e.g., fixed relative to a frame).

Figure 37:
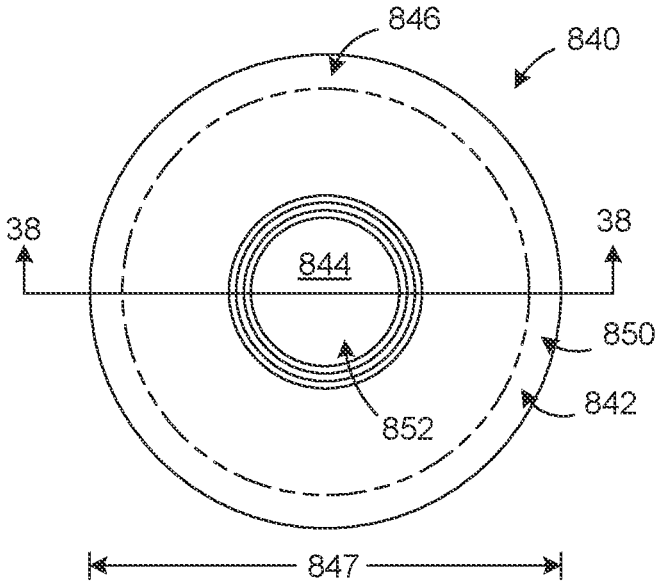
FIG. 37 is a top view of a locking member of the exercise apparatus illustrated in FIG. 28.
Figure 38:
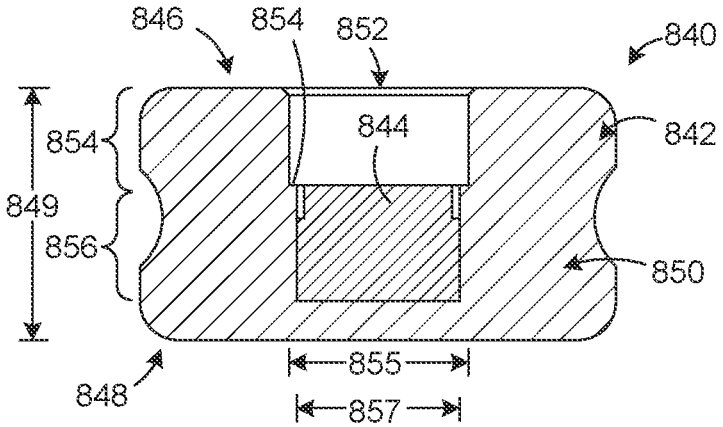
FIG. 38 is a cross-sectional view of the locking member shown in FIG. 37 taken along line 38-38.

As shown in FIGS. 28, 29, 32, 33, and 35, the first locking member 794 is releasably attached to the second end 832 of the first elongate bar 790 and the second locking member 796 is releasably attached to the second end 832 of the second elongate bar 792. Each of the first and second locking members 794, 796 prevent movement of the elongate bar within a bar passageway during use. FIGS. 37 and 38 illustrate an example locking member 840 that can be included in an exercise apparatus (e.g., first locking member 794, second locking member 796). The locking member 840 includes a base 842 and a magnetic member 844. The base 842 has a first end 846, a second end 848, a length 847, a width 849, and a main body 850 that defines a recess 852 and a shoulder 854. The recess 852 extends from the first end 846 toward the second end 848. The recess 852 has a first portion 854 and a second portion 856. The first portion 854 extends from the first end 846 to the second portion 856. The second portion 856 extends from the first portion 854 to the main body 850. The shoulder 854 is defined between the first portion 854 and the second portion 856. The first portion 854 has a first diameter 855 and the second portion 856 has a second diameter 857 that is less than the first diameter 855. The first diameter 855 is greater than the second width 837 of an elongate bar such that an elongate bar can be positioned within the first portion 854. The shoulder 854 provides a mechanical stop to advancement of an elongate bar within the recess 852. The magnetic member 844 is disposed within the second portion 856 and is formed of a second material that magnetically attracts the first material forming an elongate bar.

While the elongate bar and locking member have been illustrated as having a particular structural arrangement, an elongate bar and a locking member can have any suitable structural arrangement. For example, an elongate bar can have any suitable structural arrangement that prevents translation of a handle within a handle passageway and/or a locking member can have any suitable structural arrangement that prevents movement of an elongate bar within a bar passageway. While shown, a locking member can be omitted from an exercise apparatus such that only one or more elongate bars are included to prevent translation of a handle within a handle passageway. Selection of a suitable type of magnetic member to include in a locking member can be based on various considerations, including the material that forms an elongate bar. Examples of types of magnetic members considered suitable to include in a locking member include permanent magnets, such as ferrite magnets, neodymiumiron boron magnets, samarium cobalt magnets, alnico magnets, ceramic magnets, and any other magnetic considered suitable for a particular embodiment.

An elongate bar and/or locking member can be formed of any suitable material and manufactured using any suitable technique or method of manufacture. Selection of a suitable material and technique or method of manufacture can be based on various considerations, including the structural arrangement of the exercise apparatus of which the feature is a component. Examples of materials considered suitable to form an elongate bar and locking member include wood, polymers, plastics, metals, steel, stainless steel, carbon steel, aluminum, combinations of the materials described herein, and any other material considered suitable for a particular embodiment. Examples of techniques and methods of manufacture considered suitable to form an elongate member and locking member include injection molding, casting, cold rolling, laser cutting, finish machining, punching, and any other technique or method considered suitable for a particular embodiment.

While some of the embodiments illustrated herein relate to various configurations for bench press bars, an exercise apparatus can form any suitable structure. Selection of a suitable structure to incorporate an exercise apparatus, as described herein, can be based on various considerations, including the exercise intended to be accomplished. Examples of suitable structures to incorporate an exercise apparatus, such as those described herein, include barbells (e.g., an exercise apparatus can include a first frame, a first handle, and first and second shafts that can be sized and configured to receive one or more free weights or can include weights that are integral components of the first and second shafts), handles for exercise machines (e.g., an exercise apparatus can include a first frame and a first handle, the first frame include an eyelet attached to a housing such that the first frame can be releasably attached to a separate component (e.g., wired lift machine)), grips for exercise machines, and any other structure considered suitable for a particular embodiment. For example, a frame and/or a handle (e.g., first frame, second frame, first handle, second handle), such as those described herein, can be claimed without any other component and/or can omit any of the components associated with a frame and/or handle.

Those with ordinary skill in the art will appreciate that various modifications and alternatives for the described and illustrated embodiments can be developed in light of the overall teachings of the disclosure, and that the various elements and features of one example described and illustrated herein can be combined with various elements and features of another example without departing from the scope of the invention. Accordingly, the particular arrangement of elements disclosed herein have been selected by the inventor(s) simply to describe and illustrate examples of the invention and are not intended to limit the scope of the invention or its protection, which is to be given the full breadth of the appended claims and any and all equivalents thereof.

What is claimed is:

1. An exercise apparatus having a lengthwise axis and comprising:

a first shaft having a first shaft first end and a first shaft second end;

a first frame attached to the first shaft first end, the first frame defining a first frame passageway having a length;

a first elongate bar disposable through the first frame;

a first handle rotatably attached to the first frame and disposed within the first frame passageway, the first handle comprising a ring member and a handle shaft attached to and disposed within the ring member, the first handle rotatable within the first frame passageway such that as the ring member rotates within the first frame passageway, an orientation of the handle shaft relative to the lengthwise axis changes, wherein when the first elongate bar is not disposed through the first frame passageway:

the first handle translatable along said lengthwise axis and said length of the first frame passageway between a first position in which the first handle is disposed a first distance from the first shaft and a second position in which the first handle is disposed a second distance from the first shaft, the second distance being greater than the first distance, and the first handle having 360 degrees of rotation within the first frame passageway, wherein when the first elongate bar is disposed through the first frame passageway:

the first handle is fixed along said lengthwise axis and said length of the first a frame passageway and relative to the frame, while having 360 degrees of rotation within the first frame passageway;

a second frame attached to the first shaft second end, the second frame defining a second frame passageway; and a second handle rotatably attached to the second frame and disposed within the second frame passageway, the second handle rotatable within the second frame passageway and moveable along said lengthwise axis between a third position in which the second handle is disposed a third distance from the first shaft and a fourth position in which the second handle is disposed a fourth distance from the first shaft, the fourth distance being greater than the third distance.

2. The exercise apparatus of claim 1, wherein the first frame has a housing, a first track member, a second track member, a plurality of ball bearings, a first cover, and a second cover, each of the first and second track members attached to the housing, a first set of ball bearings of the plurality of ball bearings disposed between the first track member and the first cover, a second set of ball bearings of the plurality of ball bearings disposed between the second track member and the second cover, and each of the first and second covers attached to the housing.

3. The exercise apparatus of claim 2, wherein each ball bearing of the first set of ball bearings is moveably disposed between the first track member and the first cover.

4. The exercise apparatus of claim 2, wherein the first track member partially surrounds the first frame passageway.

5. The exercise apparatus of claim 2, wherein the housing defines a first track member recess and a second track member recess, wherein the first track member is disposed within the first track member recess, and wherein the second track member is disposed within the second track member recess.

6. The exercise apparatus of claim 2, wherein the first handle is disposed between the first and second track members.

7. The exercise apparatus of claim 1, further comprising:

a second shaft having a second shaft first end and a second shaft second end, the second shaft first end attached to the first frame; and a third shaft having a third shaft first end and a third shaft second end, the third shaft first end attached to the second frame.

8. The exercise apparatus of claim 1, wherein the second handle has 360 degrees of rotation within the second frame passageway.

9. The exercise apparatus of claim 1, wherein the second handle comprises a ring member and a handle shaft attached to the ring member.

10. The exercise apparatus of claim 1, further comprising a locking member releasably attached to the first elongate bar.

11. An exercise apparatus having a lengthwise axis and comprising:

a frame having a housing and defining a frame passageway having a length, the housing having a first end and a second end;

a first elongate bar disposable through the frame; and a handle rotatably attached to the frame and disposed within the frame passageway, the handle comprising a ring member and a handle shaft attached to and disposed within the ring member, the handle rotatable within the frame passageway such that as the ring member rotates within the frame passageway, an orientation of the handle shaft relative to the lengthwise axis changes, wherein when the first elongate bar is not disposed through the frame passageway:

the handle translatable along said lengthwise axis and said length of the frame passageway between a first position in which the handle is disposed a first distance from the first end of the housing and a second position in which the handle is disposed a second distance from the first end of the housing, the second distance being greater than the first distance, and the handle having 360 degrees of rotation within the frame passageway, and wherein when the first elongate bar is disposed through the frame passageway:

the handle is fixed along said lengthwise axis and said length of the frame passageway and relative to the frame, while having 360 degrees of rotation within the frame passageway.

12. The exercise apparatus of claim 11, wherein the frame has a first track member, a second track member, a plurality of ball bearings, a first cover, and a second cover, each of the first and second track members attached to the housing, a first set of ball bearings of the plurality of ball bearings disposed between the first track member and the first cover, a second set of ball bearings of the plurality of ball bearings disposed between the second track member and the second cover, and each of the first and second covers attached to the housing.

13. The exercise apparatus of claim 12, wherein each ball bearing of the first set of ball bearings is moveably disposed between the first track member and the first cover.

14. The exercise apparatus of claim 12, wherein the first track member partially surrounds the frame passageway.

15. The exercise apparatus of claim 12, wherein the housing defines a first track member recess and a second track member recess, wherein the first track member is disposed within the first track member recess, and wherein the second track member is disposed within the second track member recess.

16. The exercise apparatus of claim 12, wherein the handle is disposed between the first and second track members.

17. An exercise apparatus having a lengthwise axis and comprising:

a frame having a housing, a first track member, a second track member, a plurality of ball bearings, a first cover, and a second cover, the housing having a first end, and a second end, each of the first and second track members attached to the housing, a first set of ball bearings of the plurality of ball bearings disposed between the first track member and the first cover, a second set of ball bearings of the plurality of ball bearings disposed between the second track member and the second cover, each of the first and second covers attached to the housing, the frame defining a frame passageway having a length;

a first elongate bar disposable through the frame; and a handle rotatably attached to the frame and disposed within the frame passageway, the handle comprising a ring member and a handle shaft attached to and disposed within the ring member, the handle rotatable within the frame passageway such that as the ring member rotates within the frame passageway, an orientation of the handle shaft relative to the lengthwise axis changes, wherein when the first elongate bar is not disposed through the frame passageway:

the handle translatable along said lengthwise axis and said length of the frame passageway between a first position in which the handle is disposed a first distance from the first end of the housing and a second position in which the handle is disposed a second distance from the first end of the housing, the second distance being greater than the first distance, and the handle having 360 degrees of rotation within the frame passageway, and wherein when the first elongate bar is disposed through the frame passageway:

the handle is fixed along said lengthwise axis and said length of the frame passageway and relative to the frame, while having 360 degrees of rotation within the frame passageway.

* * * * *